US006776715B2

(12) United States Patent
Price

(10) Patent No.: US 6,776,715 B2
(45) Date of Patent: Aug. 17, 2004

(54) METHOD AND APPARATUS FOR PROVIDING A PERSONAL WIDE AREA PROGRESSIVE FOR GAMING APPARATUS

(75) Inventor: Derrick Price, Las Vegas, NV (US)

(73) Assignee: IGT, Reno, NV (US)

( * ) Notice: Subject to any disclaimer, the term of this patent is extended or adjusted under 35 U.S.C. 154(b) by 0 days.

(21) Appl. No.: 10/061,508

(22) Filed: Feb. 1, 2002

(65) Prior Publication Data

US 2003/0148808 A1 Aug. 7, 2003

(51) Int. Cl.[7] ..... G06F 17/00
(52) U.S. Cl. ..... 463/27; 463/26; 463/25
(58) Field of Search ..... 463/25, 26, 27, 463/40, 42, 43, 16, 17, 29

(56) References Cited

U.S. PATENT DOCUMENTS

| | | | | |
|---|---|---|---|---|
| 4,856,787 | A | 8/1989 | Itkis | 273/237 |
| 5,116,055 | A | 5/1992 | Tracy | |
| 5,280,909 | A | 1/1994 | Tracy | |
| 5,292,127 | A | 3/1994 | Kelly et al. | |
| 5,344,144 | A | 9/1994 | Canon | |
| 5,472,194 | A | 12/1995 | Breeding et al. | |
| 5,536,016 | A | 7/1996 | Thompson | |
| 5,580,309 | A | 12/1996 | Piechowiak et al. | |
| 5,611,730 | A | 3/1997 | Weiss | |
| 5,613,912 | A | 3/1997 | Slater | 463/25 |
| 5,655,961 | A | 8/1997 | Acres et al. | |
| 5,702,304 | A | 12/1997 | Acres et al. | |
| 5,741,183 | A | 4/1998 | Acres et al. | |
| 5,743,523 | A | 4/1998 | Kelly et al. | |
| 5,752,882 | A | 5/1998 | Acres et al. | |
| 5,761,647 | A | 6/1998 | Boushy | |
| 5,770,533 | A | 6/1998 | Franchi | 463/42 |
| 5,816,918 | A | 10/1998 | Kelly et al. | |
| 5,820,459 | A | 10/1998 | Acres et al. | |
| 5,833,540 | A | 11/1998 | Miodunski et al. | |
| 5,836,817 | A | 11/1998 | Acres et al. | |
| 5,885,158 | A | 3/1999 | Torango et al. | |
| 5,919,091 | A | 7/1999 | Bell et al. | |
| 6,059,289 | A | 5/2000 | Vancura | |
| 6,162,122 | A | 12/2000 | Acres et al. | 463/29 |
| 6,210,276 | B1 | 4/2001 | Mullins | |
| 6,302,793 | B1 | 10/2001 | Fertitta, III et al. | |
| 6,319,125 | B1 | 11/2001 | Acres | |
| 6,336,857 | B1 | 1/2002 | McBride | |
| 2002/0142846 | A1 * | 10/2002 | Paulsen | 463/43 |
| 2003/0078101 | A1 * | 4/2003 | Schneider et al. | 463/42 |

FOREIGN PATENT DOCUMENTS

EP 1 063 622 A2 12/2000

OTHER PUBLICATIONS

International Search Report for PCT/US02/11106 completed Apr. 22, 2003.

International Preliminary Examination Report for International Application No. PCT/US02/11106 dated Dec. 4, 2003.

* cited by examiner

*Primary Examiner*—Jessica Harrison
(74) *Attorney, Agent, or Firm*—Marshall, Gerstein & Borun LLP

(57) ABSTRACT

A gaming apparatus is disclosed having a display unit capable of generating video images; a value input device; a player tracking card reader; and a controller. The controller being programmed to read a player tracking card, to acquire player tracking data from a database, and determine if a player is a personal progressive member. The controller also being programmed to evaluate an outcome of a game to determine if the outcome was a qualified personal progressive jackpot win; to increment a credit account for the player by a personal progressive jackpot total if the outcome was a qualified personal progressive jackpot win; to reset the personal progressive jackpot total if the outcome was a qualified personal progressive jackpot win; and to increment the credit account by a contribution amount if the outcome was not a qualified personal progressive win.

29 Claims, 15 Drawing Sheets

200
MAIN
ATTRACT
202
PLAYER
204
NO
YES
PLAYER TRACKING CARD?
206
NO
YES
ACQUIRE PLAYER TRACKING DATA FROM DATABASE
260
ACTIVE PERSONAL WIDE AREA PROGRESSIVE MEMBER?
262
NO
YES
DISPLAY CURRENT PLAYER TRACKING DATA
264
GENERATE GAME DISPLAY
208
GAME SELECTION?
266
NO
YES
A
B
C

FIG. 9
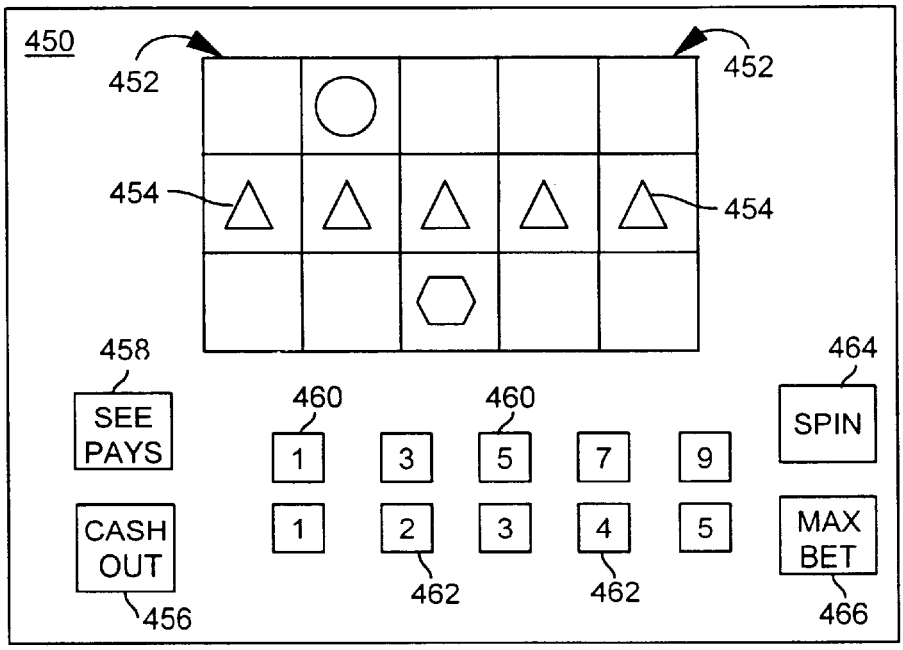
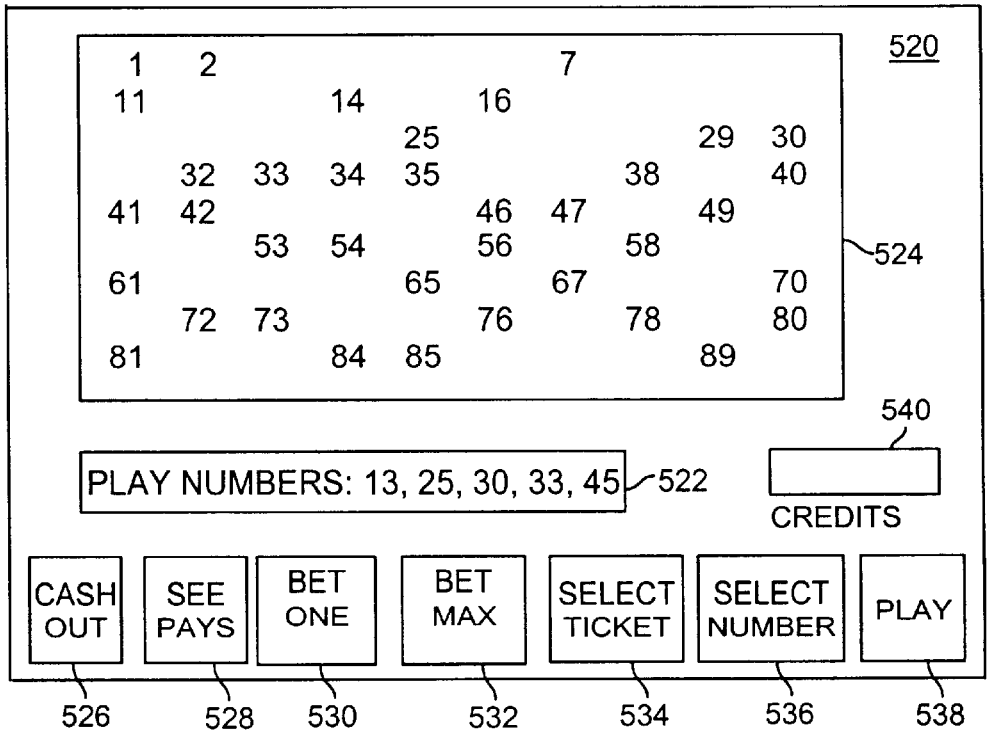
FIG. 10

METHOD AND APPARATUS FOR PROVIDING A PERSONAL WIDE AREA PROGRESSIVE FOR GAMING APPARATUS

BACKGROUND OF THE INVENTION

Traditional gaming apparatuses or units (including lottery apparatuses) are utilized in a variety of ways, including individual gaming units, components of a gaming system having a plurality of gaming units, or a network-based system (e.g., a LAN (Local Area Network), a WAN (Wide Area Network), an intranet, or the Internet) having a plurality of gaming apparatuses.

These conventional gaming apparatuses are often equipped with card readers to allow players to use a wide variety of cards to play games found on the gaming apparatuses instead of using coins, bills, chips, etc. These cards may also be player tracking cards which store and track personal and gaming information about players. In conventional applications, these player tracking cards are compatible with only one brand of gaming apparatuses. Additionally, the player tracking cards are often unique for each facility and cannot be used in multiple facilities.

It is also known in the prior art that progressive gaming systems may be provided that have a plurality of individual gaming units operatively linked together to allow the generation of a relatively large, community wide, progressive jackpot that may be won by one of the players using one of the individual gaming units in the progressive system. In these progressive systems, a nominal amount of each player's wager is contributed to the community progressive jackpot until one of the many players wins a top qualifying game.

SUMMARY OF THE INVENTION

In accordance with a first aspect of the invention, a gaming apparatus is provided. The gaming apparatus comprises a display unit that is capable of generating video images, a value input device, a player tracking card reader, and a controller. The controller is operatively coupled to the display unit, the value input device, and the player tracking card reader. The controller may comprise a processor and a memory operatively coupled to the processor. The controller may be programmed to allow a person to make a wager. The controller may be further programmed to cause a video image to be generated on the display unit. The video image may represent a game selected from the group of games consisting of video poker, video blackjack, video slots, video keno and video bingo. The video image may comprise an image of at least five playing cards if the game comprises video poker. The video image may comprise an image of a plurality of simulated slot machine reels if the game comprises video slots. If the game comprises video blackjack, the video image may comprise an image of a plurality of playing cards. Also, the video image may comprise an image of a plurality of keno numbers if the game comprises video keno, and the video image may comprise an image of a bingo grid if the game comprises video bingo.

In addition, the controller may be programmed to read a player tracking card, acquire player tracking data from a player tracking database, and determine if a player is a personal wide area progressive member. Still further, the controller may be programmed to evaluate an outcome of the game represented by the video image. In addition, the controller may be programmed to determine if the outcome of the game was a qualified personal wide area progressive jackpot win. The controller may also be programmed to increment a credit account for the player by a personal wide area progressive jackpot total if the outcome of the game was a qualified personal wide area progressive jackpot win. Additionally, the controller may be programmed to reset the personal wide area progressive jackpot total if the outcome of the game was a qualified personal wide area progressive jackpot win. Also, the controller may be programmed to increment the credit account for the player by a contribution amount if the outcome of the game was not a qualified personal wide area progressive jackpot win. The controller for the gaming apparatus may also be programmed to prompt the user to become a personal wide area progressive member if it is determined that the player was not currently a personal wide area progressive member. Also, the player tracking database may comprise a remote, central database, or a local, satellite database that is periodically updated by a remote, central database. As for the contribution amount, it may comprise either a percentage of a player's wager, or a predetermined amount less than one dollar.

The gaming apparatus' controller may also be further programmed to lock the gaming apparatus and perform a jackpot verification if the outcome of the game was a qualified personal wide area progressive jackpot win. The controller may also be programmed to reset the personal wide area progressive jackpot total to an amount correlating to the player's gaming history if the outcome of the game was a qualified personal wide area progressive jackpot win. Additionally, the controller may be further programmed to generate a player status video image representing current player tracking data. For example, the controller may display the player's current jackpot balance.

A plurality of these gaming apparatuses may be interconnected to form a network of gaming apparatuses, wherein the gaming apparatuses are located in a plurality of facilities with each of the gaming apparatuses having access to the player tracking database.

In accordance with a second aspect of the invention, a gaming apparatus comprising a display unit that is capable of generating video images, a value input device, and a player tracking card reader, may be provided. The gaming apparatus may also include a controller that is operatively coupled to the display unit, the value input device, and the player tracking card reader. The controller may comprise a processor and a memory operatively coupled to the processor. The controller may be programmed to allow a person to make a wager. Also, the controller may be programmed to cause a video image to be generated on the display unit, wherein the video image represents a game. In addition, the controller may be programmed to read a player tracking card, acquire player tracking data from a player tracking database, and determine if a player is a personal wide area progressive member.

The controller may also be programmed to evaluate an outcome of the game represented by the video image, and to determine if the outcome of the game was a qualified personal wide area progressive jackpot win. Additionally, the controller may be programmed to increment a credit account for the player by a personal wide area progressive jackpot total and to reset the personal wide area progressive jackpot total to an amount correlating to said player's gaming history, if the outcome of the game was a qualified personal wide area progressive jackpot win. Also, the controller may be programmed to increment the credit account for the player by a contribution amount if the outcome of the game was not a qualified personal wide area progressive jackpot win.

In accordance with a third aspect of the invention, a gaming apparatus is provided comprising a display unit that is capable of generating video images, a value input device, and a player tracking card reader. The gaming apparatus may also include a controller that is operatively coupled to the display unit, the value input device, and the player tracking card reader. The controller may also comprise a processor and a memory operatively coupled to the processor. The controller may be programmed to allow a person to make a wager and to make a payline selection. In addition, the controller may be programed to cause a video image to be generated on the display unit wherein the video image may comprise a plurality of simulated slot machine reels of a slots game. The slot machine reels may have a plurality of slot machine symbols. Additionally, the controller may be programmed to read a player tracking card, acquire player tracking data from a player tracking database, and determine if a player is a personal wide area progressive member. In addition, the controller may be programmed to determine the value pay out associated with an outcome of the slots game, based on a configuration of the slot machine symbols.

The controller associated with the gaming apparatus may also be programmed to determine if the outcome of the slots game was qualified personal wide area progressive jackpot win. If the outcome of the slots game was a qualified personal wide area progressive jackpot win, then the controller may also be programmed to increment a credit account for the player by personal wide area progressive jackpot total and to reset the personal wide area progressive jackpot total to an amount correlating to said player's gaming history. If the outcome of the slots game was not a qualified personal wide area progressive jackpot win, then the controller may be programmed to add a percentage of a monetary value of said wager to a current monetary value of said personal wide area progressive jackpot.

In accordance with a fourth aspect of the invention, a gaming method may be provided. The gaming method may comprise causing a video image to be generated, wherein the video image represents a game selected from the group of games consisting of video poker, video blackjack, video slots, video keno, and video bingo. The video image may comprise an image of at least five playing cards if the game comprises video poker. Also, the video image may comprise an image of a plurality of simulated slot machine reels if the game comprises video slots. Similarly, the video image may comprise an image of a plurality of playing cards if the game comprises video blackjack. The video image may also comprise an image of a plurality of keno numbers if the game comprises video keno. Also, the video image may comprise an image of a bingo grid if the game comprises video bingo.

The gaming method may also comprise reading a player tracking card and acquiring player tracking data from a player tracking data base. In addition, the gaming method may comprise determining if a player is a personal wide area progressive member that is eligible to win a personal wide area progressive jackpot. The gaming method may further comprise evaluating an outcome of the game represented by the video image as well as determining if the outcome of the game was a qualified personal wide area progressive jackpot winner. Additionally, the gaming method may include incrementing a credit account for the player by a personal wide area progressive jackpot total if the outcome of the game was a qualified personal wide area progressive jackpot win. Additionally, the gaming method may include resetting the personal wide area progressive jackpot total if the outcome of the game was a qualified personal wide area progressive jackpot win, and incrementing the credit account by a contribution amount if the outcome of the game was not a qualified personal wide area progressive jackpot win.

In accordance with a fifth aspect of the invention, a memory may be provided, wherein the memory has a computer program stored therein that is capable of being used in connection with a gaming apparatus. The memory may comprise a first memory portion physically configured in accordance with computer program instructions that would cause the gaming apparatus to allow a person to make a wager. Additionally, the memory may include a second memory portion physically configured in accordance with computer program instructions that would cause the gaming apparatus to cause a video image to be generated on a display unit, wherein the video image would represent a game selected from the group of games consisting of video poker, video blackjack, video slots, video keno, and video bingo. A third memory portion may also be included in the memory that is physically configured in accordance with computer program instructions that would cause the gaming apparatus to read a player tracking card, acquire player tracking data from a player tracking database, and determine if a player is a personal wide area progressive member.

The memory may also comprise a fifth memory portion physically configured in accordance with computer program instructions that would cause a gaming apparatus to determine if the outcome of the game was a qualified personal wide area progressive jackpot win. The memory may also comprise a sixth and a seventh memory portion that are physically configured in accordance with computer program instructions that would cause the gaming apparatus to increment a credit account for the player by personal wide area progressive jackpot total and to reset the personal wide area progressive jackpot total to an amount correlating to said player's gaming history, if the outcome of the game was a qualified personal wide area progressive jackpot win. Additionally, the memory may comprise an eighth memory portion physically configured in accordance with computer program instructions that would cause the gaming apparatus to increment the credit account for the player by a contribution amount if the outcome of the game was not a qualified personal wide area progressive jackpot win.

The features and advantages of the present invention will be apparent to those of ordinary skill in the art in view of the detailed description of various embodiments, which is made with reference to the drawings, a brief description of which is provided below.

BRIEF DESCRIPTION OF THE DRAWINGS

FIG. 1 is a block diagram of an embodiment of a gaming system in accordance with the invention.

FIG. 9 is an illustration of an embodiment of a visual display that may be displayed during performance of the slots routine of FIG. 11;

FIG. 10 is an illustration of an embodiment of a visual display that may be displayed during performance of the video keno routine of FIG. 12;

DETAILED DESCRIPTION OF VARIOUS EMBODIMENTS

Figure 1A:
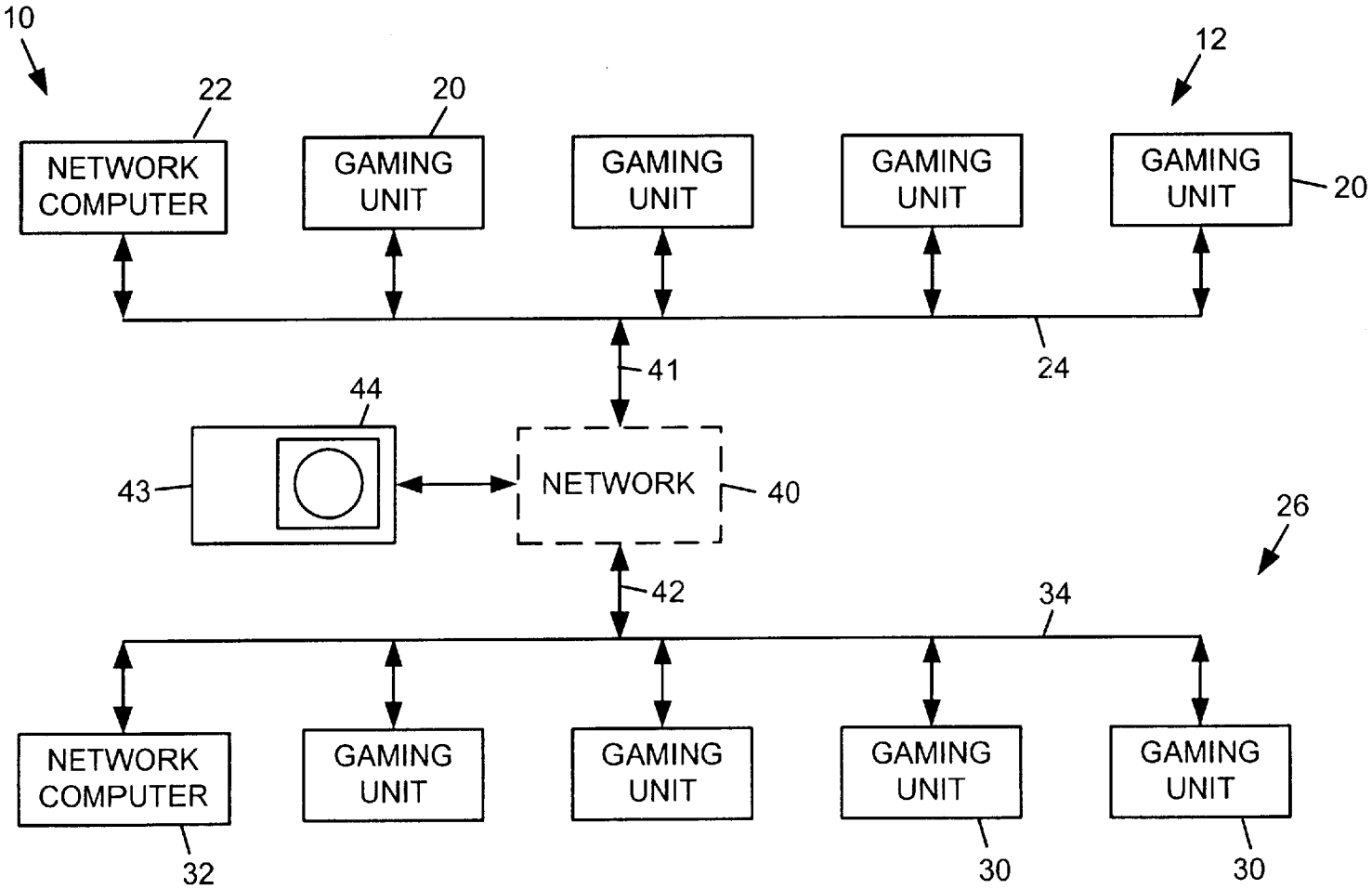
FIG. 1A is a block diagram of an embodiment of a gaming system in accordance with the invention.

FIG. 1A illustrates an embodiment of a gaming system 10 in accordance with the invention. Referring to FIG. 1A, the gaming system 10 may include a first group or network 12 of gaming units 20 operatively coupled to a network computer 22 via a network data link or bus 24. The gaming system 10 may include a second group or network 26 of gaming units 30 operatively coupled to a network computer 32 via a network data link or bus 34. The first and second gaming networks 12, 26 may be operatively coupled to each other via a network 40, which may comprise, for example, the Internet, a wide area network (WAN), or a local area network (LAN) via a first network link 41 and a second network link 42.

The first network 12 of gaming units 20 may be provided in a first casino or facility, and the second network 26 of gaming units 30 may be provided in a second facility located in a separate geographic location than the first facility. For example, the two facilities may be located in different areas of the same city, or they may be located in different states. The network 40 may include a plurality of network computers or server computers (not shown), each of which may be operatively interconnected. Where the network 40 comprises the Internet, data communication may take place over the communication links 41, 42 via an Internet communication protocol.

The network computer 22 may be a server computer and may be used to accumulate and analyze data relating to the operation of the gaming units 20. For example, the network computer 22 may continuously receive data from each of the gaming units 20 indicative of the dollar amount and number of wagers being made on each of the gaming units 20, data indicative of how much each of the gaming units 20 is paying out in winnings, data regarding the identity and gaming habits (i.e. the history) of players playing each of the gaming units 20, etc. The network computer 32 may be a server computer and may be used to perform the same or different functions in relation to the gaming units 30 as the network computer 22 described above.

Although each network 12, 26 is shown to include one network computer 22, 32 and four gaming units 20, 30, it should be understood that different numbers of computers and gaming units may be utilized. For example, the network 12 may include a plurality of network computers 22 and tens or hundreds of gaming units 20, all of which may be interconnected via the data link 24. The data link 24 may provided as a dedicated hardwired link or a wireless link. Although the data link 24 is shown as a single data link 24, the data link 24 may comprise multiple data links.

The gaming units 20 and 30 may also be connected to a remote central computer 43. The remote, central computer 43 may be a conventional computer having a microprocessor, RAM, and a database 44. The database 48 may be utilized to store player tracking data (information about the player and about the player's gaming history), including information relating to a personal wide area jackpot for the player. In this embodiment, player tracking data may be sorted and reprieved to direct links between the gaming units 20 and 30 in a remote, central computer 43.

Figure 1B:
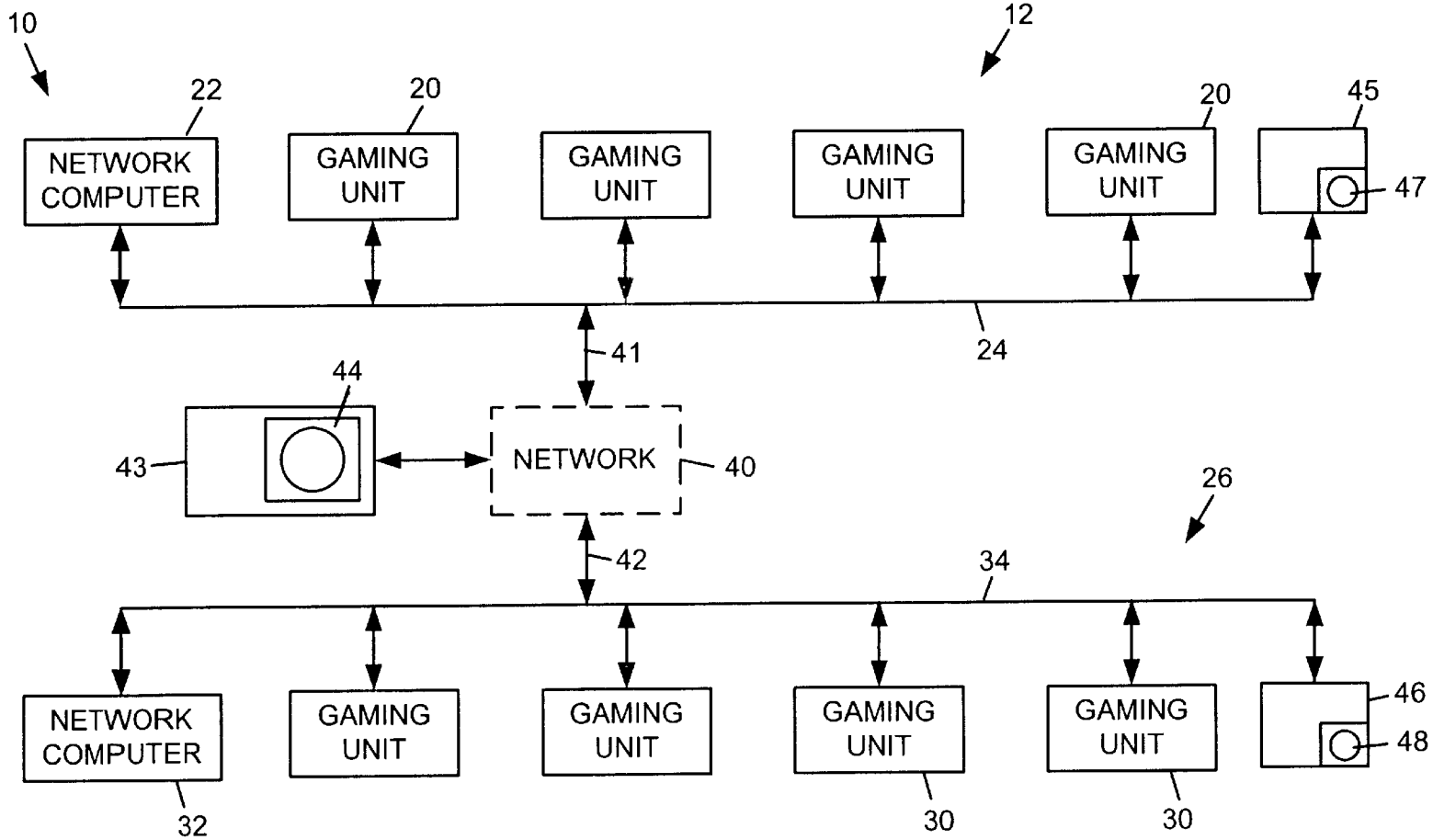
FIG. 1B is a block diagram of an alternative embodiment of a gaming system in accordance with the invention.

FIG. 1B illustrates another version of an embodiment shown in FIG. 1A, except that this embodiment also includes a first local, satellite computer 45 in a second local, satellite computer 46. The first local, satellite computer 45 may comprise a microprocessor, RAM, and a database 47. The first local, satellite computer 45 may be located in the first facility and may be connected to the gaming unit 20. Likewise, the second local, satellite computer 46 may also comprise a microprocessor, RAM, and a database 48. The second local, satellite computer 46 may also be connected to the gaming units 30 may be located in the first facility and connected to the gaming units 30. The first and second local, satellite computers 45 and 46 may be linked to the remote, central computer 43. In this embodiment, the gaming apparatuses 20 and 23 may request player tracking data from their corresponding first and second databases 47 and 48 residing in the first and second local, satellite computers 45 and 46, respectively. Databases 47 and 48 in the first and second local, satellite computers 45 and 46 may receive periodic updates of player tracking data from the remote, central database 44. When a gaming unit 20 or 30 performs a query for player tracking data, they may first attempt to locate the data from the local, satellite computers 45 and 46, respectively. If the player's information could not be found in the databases residing in the first and second local, satellite computers, then a look-up request could be forwarded to the remote, central computer 43.

It should also be noted that the terms gaming apparatus and gaming unit are intended to be interchangeable. Additionally, the terms are intended to include video lottery terminals. Video lottery terminals operate essentially the same as gaming apparatuses found in state regulated casinos or other facilities, except that they generally use ticket printers to print tickets that can be exchanged for cash payments instead of paying winning amounts through a coin hopper as in conventional gaming apparatuses.

Figure 2:
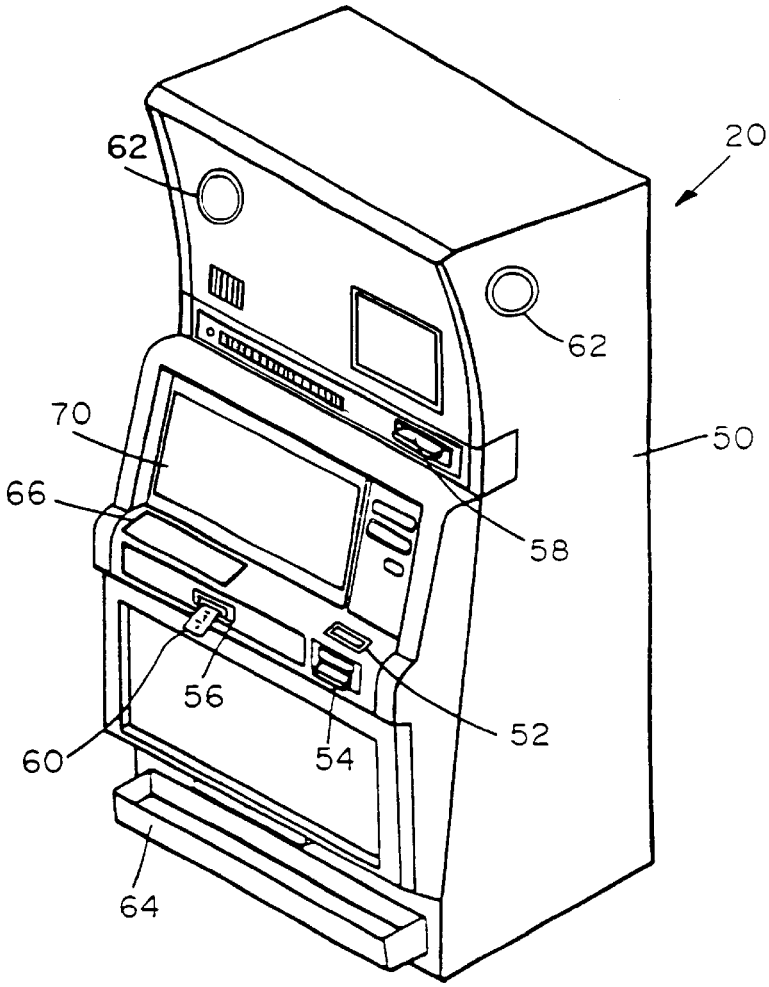
FIG. 2 is a perspective view of an embodiment of one of the gaming units shown schematically in FIG. 1.

FIG. 2 is a perspective view of one possible embodiment of one or more of the gaming units 20. Although the following description addresses the design of the gaming units 20, it should be understood that the gaming units 30 may have the same design as the gaming units 20 described below. It should be understood that the design of one or more of the gaming units 20 may be different than the design of other gaming units 20, and that the design of one or more of the gaming units 30 may be different than the design of other gaming units 30. Each gaming unit 20 may be any type of casino gaming unit and may have various different structures and methods of operation. For exemplary purposes, various designs of the gaming units 20 are described below, but it should be understood that numerous other designs may be utilized.

Referring to FIG. 2, the casino gaming unit 20 may include a housing or cabinet 50 and one or more input devices, which may include a coin slot or acceptor 52, a paper currency acceptor 54, a ticket reader/printer 56 and a card reader 58, which may be used to input value to the gaming unit 20. The card reader 58 may accept a wide variety of cards, such as a player tracking card 59. A value input device may include any device that can accept value from a customer. As used herein, the term "value" may encompass gaming tokens, coins, paper currency, ticket vouchers, credit or debit cards, and any other object representative of value.

If provided on the gaming unit 20, the ticket reader/printer 56 may be used to read and/or print or otherwise encode ticket vouchers 60. The ticket vouchers 60 may be composed of paper or another printable or encodable material and may have one or more of the following informational items printed or encoded thereon: the casino name, the type of ticket voucher, a validation number, a bar code with control and/or security data, the date and time of issuance of the ticket voucher, redemption instructions and restrictions, a description of an award, and any other information that may be necessary or desirable. Different types of ticket vouchers 60 could be used, such as bonus ticket vouchers, cash-redemption ticket vouchers, casino chip ticket vouchers, extra game play ticket vouchers, merchandise ticket vouchers, restaurant ticket vouchers, show ticket vouchers, etc. The ticket vouchers 60 could be printed with an optically readable material such as ink, or data on the ticket vouchers 60 could be magnetically encoded. The ticket reader/printer 56 may be provided with the ability to both read and print ticket vouchers 60, or it may be provided with the ability to only read or only print or encode ticket vouchers 60. In the latter case, for example, some of the gaming units 20 may have ticket printers 56 that may be used to print ticket vouchers 60, which could then be used by a player in other gaming units 20 that have ticket readers 56.

If provided, the card reader 58 may include any type of card reading device, such as a magnetic card reader or an optical card reader, and may be used to read data from the card 59 offered by a player, such as a credit card or a player tracking card. If provided for player tracking purposes, the card reader 58 may be used to read data from, and/or write data to, player tracking cards that are capable of storing data representing the identity of a player, the identity of a casino, the player's gaming habits, etc.

The gaming unit 20 may include one or more audio speakers 62, a coin payout tray 64, an input control panel 66, and a color video display unit 70 for displaying images relating to the game or games provided by the gaming unit 20. The audio speakers 62 may generate audio representing sounds such as the noise of spinning slot machine reels, a dealer's voice, music, announcements or any other audio related to a casino game. The gaming apparatus may include a plurality of mechanically rotatably reels, wherein each of the plurality of mechanical reels have a plurality of symbols or images formed thereon. Each of the mechanically rotatably reels may be independently rotatable. The gaming apparatus may further include a transparent display member disposed in the housing 50 so that the images formed on the reels are visible to a player. The input control panel 66 may be provided with a plurality of pushbuttons or touch-sensitive areas that may be pressed by a player to select games, make wagers, make gaming decisions, etc.

The gaming unit 20 may function solely as a mechanical slots gaming apparatus, wherein the mechanical slots gaming apparatus may replace the color video display 70 with a transparent display portion in the housing 50 that allows viewing of a plurality of mechanically rotatable reels. Each of the mechanical reels may be independently rotatable about an axis and may have a plurality of slot machine symbols formed on a surface of the mechanical reels. The mechanical reels may be disposed within the housing so that the slot machine symbols are visible to a player through the transparent display portion.

Figure 2A:
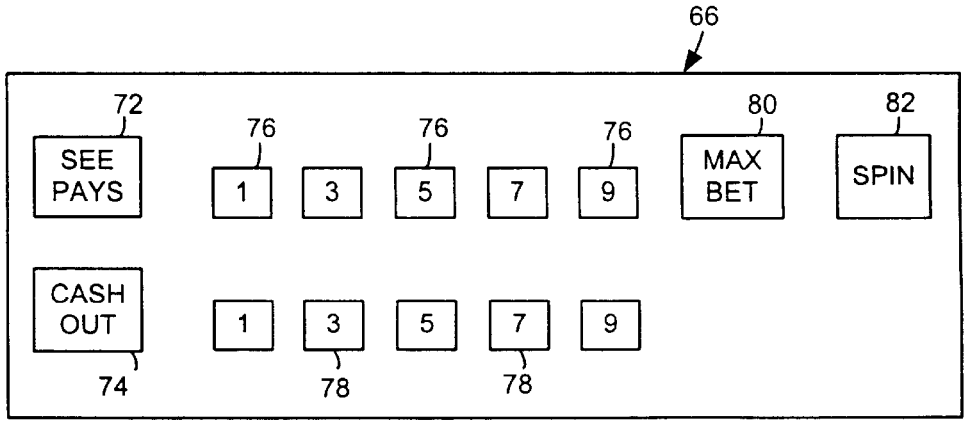
FIG. 2A illustrates an embodiment of a control panel for a gaming unit.

FIG. 2A illustrates one possible embodiment of the control panel 66, which may be used where the gaming unit 20 is a slot machine having a plurality of mechanical or "virtual" reels. Referring to FIG. 2A, the control panel 66 may include a "See Pays" button 72 that, when activated, causes the display unit 70 to generate one or more display screens showing the odds or payout information for the game or games provided by the gaming unit 20. As used herein, the term "button" is intended to encompass any device that allows a player to make an input, such as an input device that must be depressed to make an input selection or a display area that a player may simply touch. The control panel 66 may include a "Cash Out" button 74 that may be activated when a player decides to terminate play on the gaming unit 20, in which case the gaming unit 20 may return value to the player, such as by returning a number of coins to the player via the payout tray 64.

If the gaming unit 20 provides a slots game having a plurality of reels and a plurality of paylines which define winning combinations of reel symbols, the control panel 66 may be provided with a plurality of selection buttons 76, each of which allows the player to select a different number of paylines prior to spinning the reels. For example, five buttons 76 may be provided, each of which may allow a player to select one, three, five, seven or nine paylines.

If the gaming unit 20 provides a slots game having a plurality of reels, the control panel 66 may be provided with a plurality of selection buttons 78 each of which allows a player to specify a wager amount for each payline selected. For example, if the smallest wager accepted by the gaming unit 20 is a quarter ($0.25), the gaming unit 20 may be provided with five selection buttons 78, each of which may allow a player to select one, two, three, four or five quarters to wager for each payline selected. In that case, if a player were to activate the "5" button 76 (meaning that five paylines were to be played on the next spin of the reels) and then activate the "3" button 78 (meaning that three coins per payline were to be wagered), the total wager would be $3.75 (assuming the minimum bet was $0.25).

The control panel 66 may include a "Max Bet" button 80 to allow a player to make the maximum wager allowable for a game. In the above example, where up to nine paylines were provided and up to five quarters could be wagered for each payline selected, the maximum wager would be 45 quarters, or $11.25. The control panel 66 may include a spin button 82 to allow the player to initiate spinning of the reels of a slots game after a wager has been made.

In FIG. 2A, a rectangle is shown around the buttons 72, 74, 76, 78, 80, 82. It should be understood that that rectangle simply designates, for ease of reference, an area in which the buttons 72, 74, 76, 78, 80, 82 may be located. Consequently, the term "control panel" should not be construed to imply that a panel or plate separate from the housing 50 of the gaming unit 20 is required, and the term "control panel" may encompass a plurality or grouping of player activatable buttons.

Although one possible control panel 66 is described above, it should be understood that different buttons could be utilized in the control panel 66, and that the particular buttons used may depend on the game or games that could be played on the gaming unit 20. Although the control panel 66 is shown to be separate from the display unit 70, it should be understood that the control panel 66 could be generated by the display unit 70. In that case, each of the buttons of the control panel 66 could be a colored area generated by the display unit 70, and some type of mechanism may be associated with the display unit 70 to detect when each of the buttons was touched, such as a touch-sensitive screen.

Figure 2B:
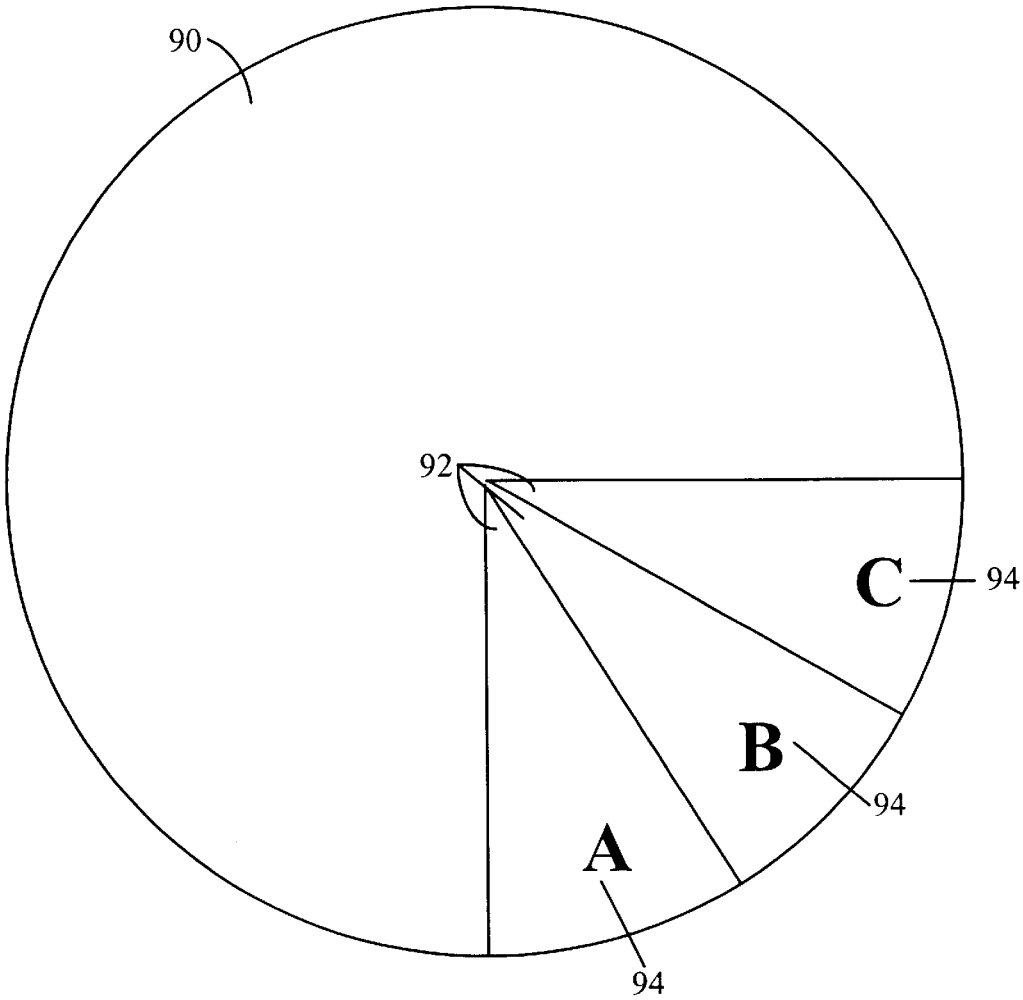
FIG. 2B illustrates an exemplary embodiment of a mechanically rotatable wheel.

FIG. 2B illustrates one possible embodiment of a mechanically rotatable reel 90, which may be used where the gaming apparatus 20 is a replication or modification of a game show having a mechanical reel. For example, the reel 90 may be used to simulate the wheel (reel) used in the game shows Wheel of Fortune® or Price is Right® or parodies thereof, in which game show contestants spin the wheel for chances to solve a puzzle or win prizes. Referring to FIG. 2B, the mechanically reel 90 may be divided into a plurality of segments or portions 92 and have a plurality of symbols or images 94 formed on those portions 92. The symbols 94 may be unique to each of the portions 92, or they may be repeated in either a systematic or random fashion. The reel 90 may also be operatively connected to a controller and a variety of input and output devices as described above with reference to FIG. 2.

Gaming Unit Electronics

Figure 3:
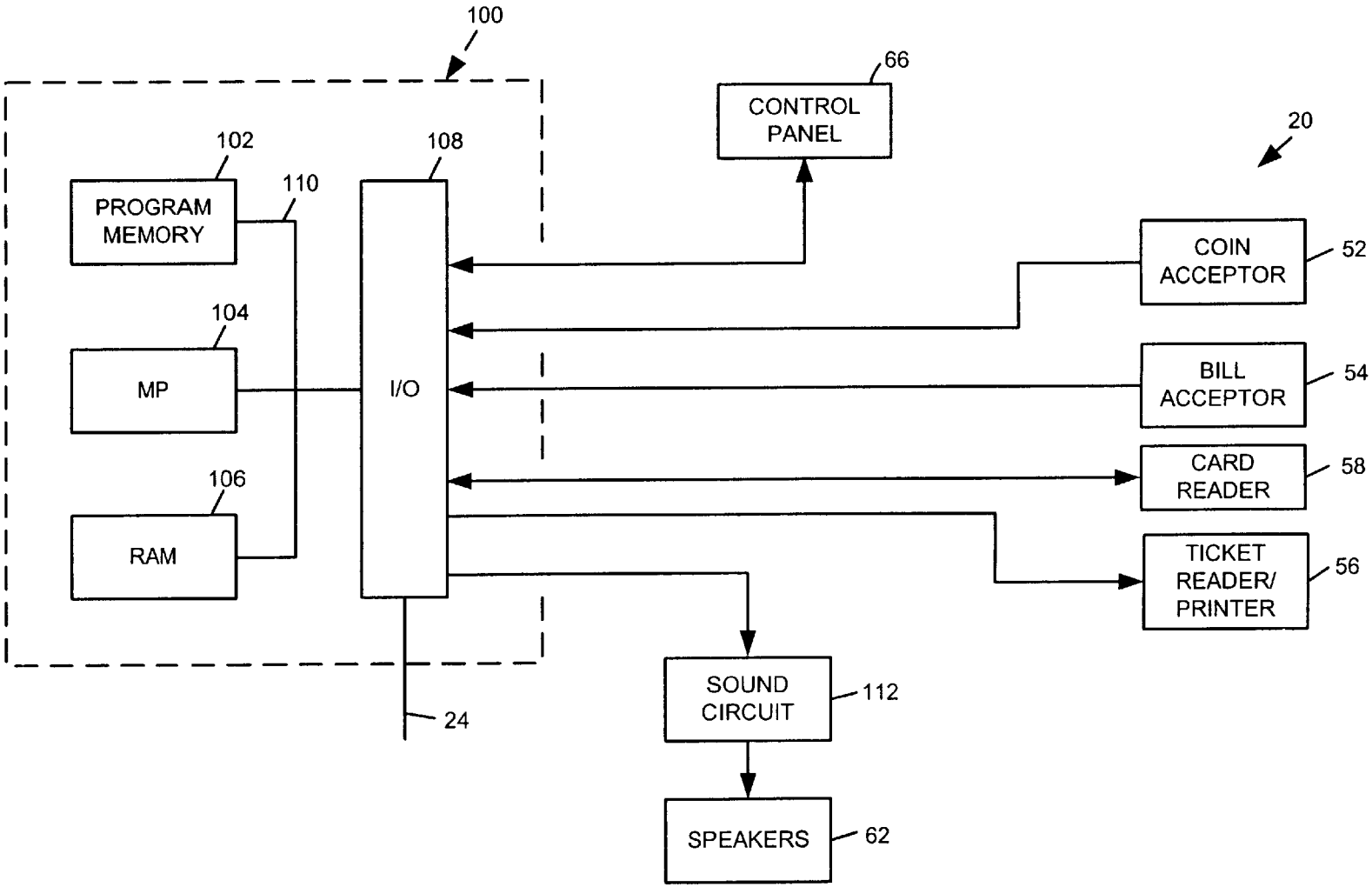
FIG. 3 is a block diagram of the electronic components of the gaming unit of FIG. 2.

FIG. 3 is a block diagram of a number of components that may be incorporated in the gaming unit 20. Referring to FIG. 3, the gaming unit 20 may include a controller 100 that may comprise a program memory 102, a microcontroller or microprocessor (MP) 104, a random-access memory (RAM) 106 and an input/output (I/O) circuit 108, all of which may be interconnected via an address/data bus 110. It should be appreciated that although only one microprocessor 104 is shown, the controller 100 may include multiple microprocessors 104. Similarly, the memory of the controller 100 may include multiple RAMs 106 and multiple program memories 102. Although the I/O circuit 108 is shown as a single block, it should be appreciated that the I/O circuit 108 may include a number of different types of I/O circuits. The RAM(s) 104 and program memories 102 may be implemented as semiconductor memories, magnetically readable memories, and/or optically readable memories, for example.

FIG. 3 illustrates that the control panel 66, the coin acceptor 52, the bill acceptor 54, the card reader 58 and the ticket reader/printer 56 may be operatively coupled to the I/O circuit 108, each of those components being so coupled by either a unidirectional or bidirectional, single-line or multiple-line data link, which may depend on the design of the component that is used. The speaker(s) 62 may be operatively coupled to a sound circuit 112, that may comprise a voice- and sound-synthesis circuit or that may comprise a driver circuit. The sound-generating circuit 112 may be coupled to the I/O circuit 108. Additionally, if the gaming unit 20 functions as a mechanical slots gaming apparatus having a plurality of mechanical reels, then the controller may be connected to the mechanical reels or to sensors that indicate the positions of the reels.

As shown in FIG. 3, the components 52, 54, 56, 58, 66, 112 may be connected to the I/O circuit 108 via a respective direct line or conductor. Different connection schemes could be used. For example, one or more of the components shown in FIG. 3 may be connected to the I/O circuit 108 via a common bus or other data link that is shared by a number of components. Furthermore, some of the components may be directly connected to the microprocessor 104 without passing through the I/O circuit 108.

Overall Operation of Gaming Unit

One manner in which one or more of the gaming units 20 (and one or more of the gaming units 30) may operate is described below in connection with a number of flowcharts which represent a number of portions or routines of one or more computer programs, which may be stored in one or more of the memories of the controller 100. The computer program(s) or portions thereof may be stored remotely, outside of the gaming unit 20, and may control the operation of the gaming unit 20 from a remote location. Such remote control may be facilitated with the use of a wireless connection, or by an Internet interface that connects the gaming unit 20 with a remote computer (such as one of the network computers 22, 32) having a memory in which the computer program portions are stored. The computer program portions may be written in any high level language such as C, C+, C++ or the like or any low-level, assembly or machine language. By storing the computer program portions therein, various portions of the memories 102, 106 are physically and/or structurally configured in accordance with computer program instructions.

Figure 4A:
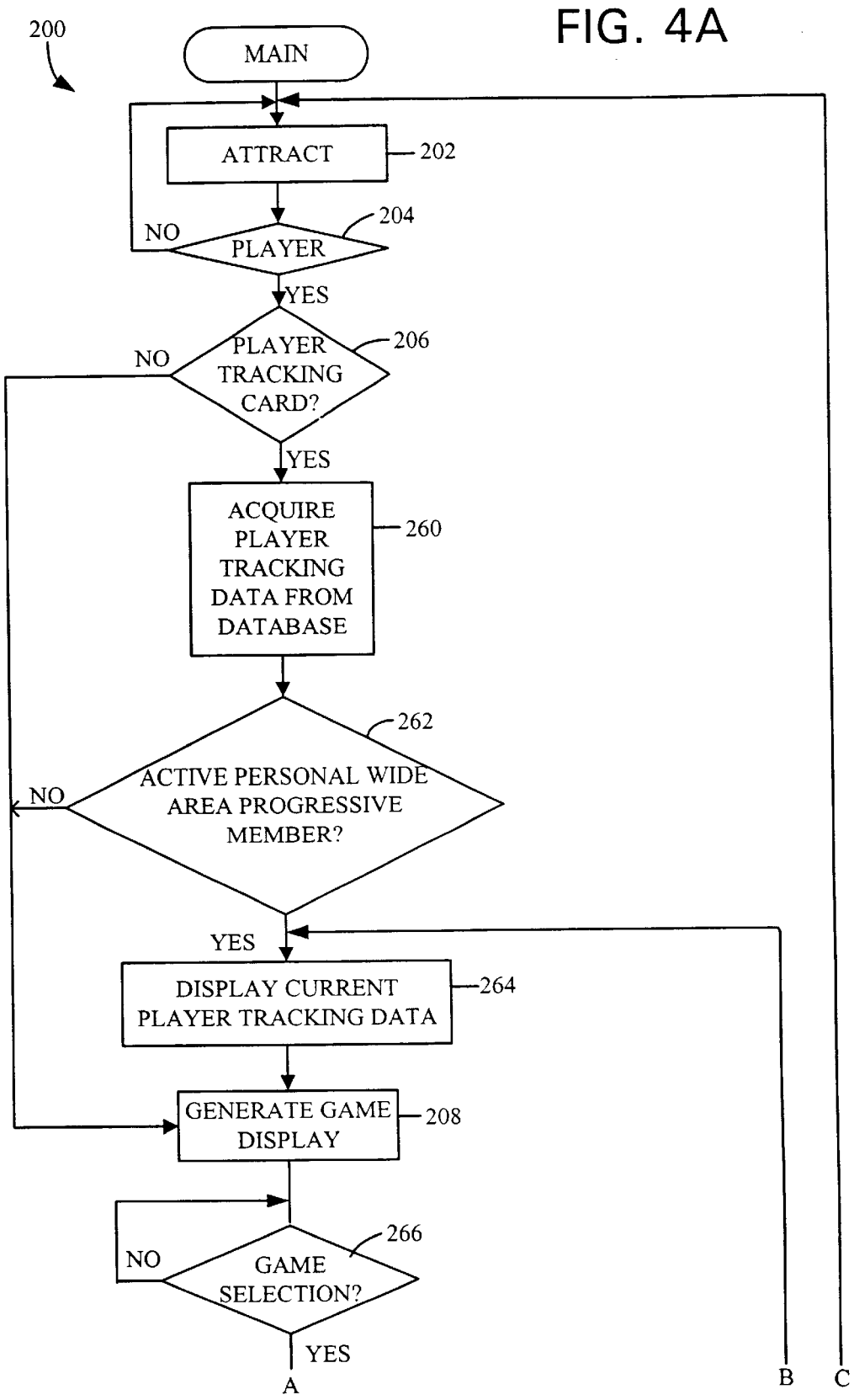
FIGS. 4A and 4B are two parts of a flowchart of an embodiment of a main routine that may be performed during operation of one or more of the gaming units.
Figure 4B:
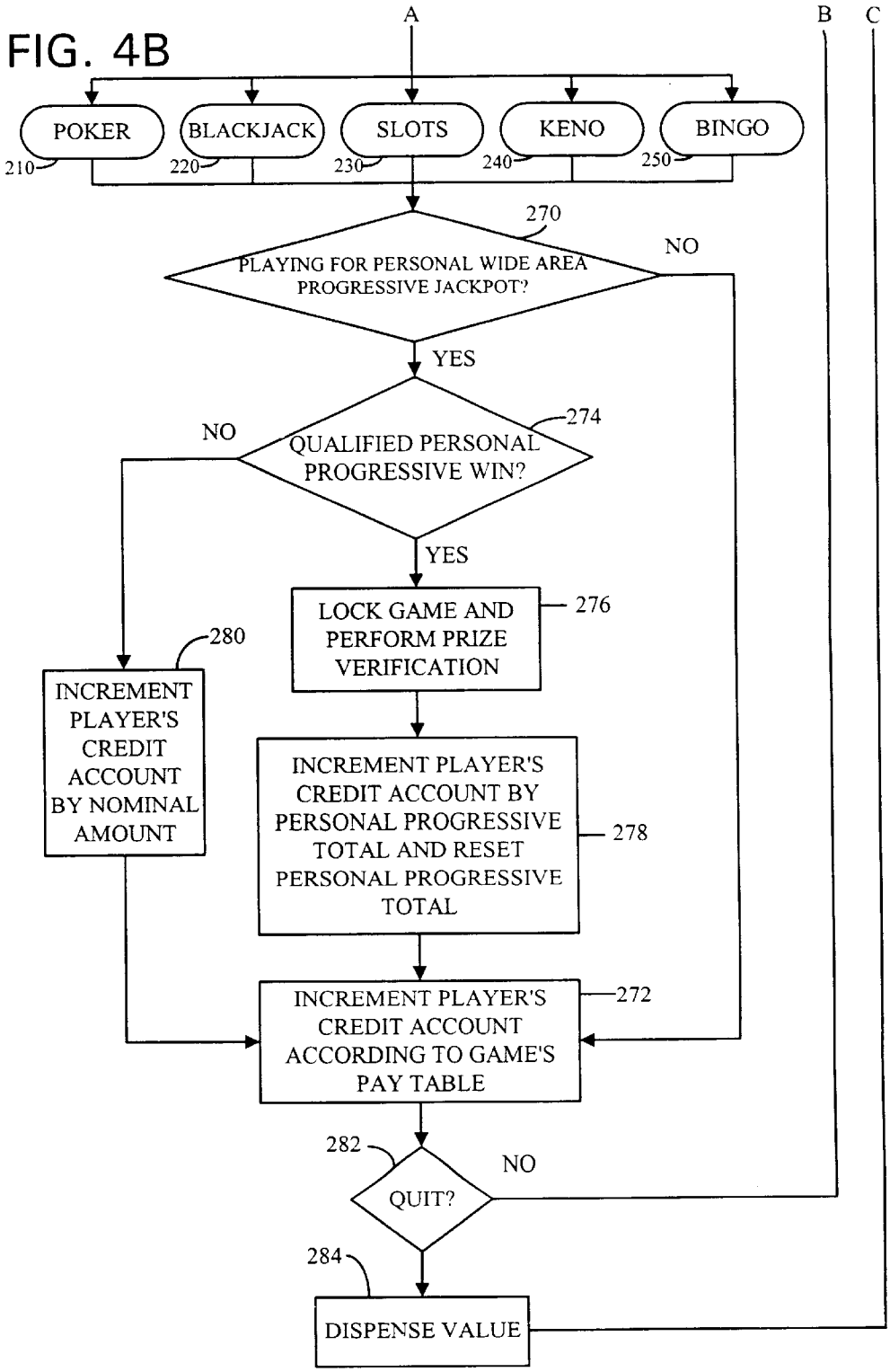

FIGS. 4A and 4B are two parts of a flowchart of a main operating routine 200 that may be stored in the memory of the controller 100. The main routine 200 may be utilized for gaming units 20 that are designed to allow players to participate in and contribute to a personal wide area progressive jackpot. Referring to FIG. 4A, the main routine 200 may begin operation at block 202 during which an attraction sequence may be performed in an attempt to induce a potential player in a casino to play the gaming unit 20.

The attraction sequence may be performed by displaying one or more video images on the display unit 70 and/or causing one or more sound segments, such as voice or music, to be generated via the speakers 62. The attraction sequence may include a scrolling list of games that may be played on the gaming unit 20 and/or video images of various games being played, such as video poker, video blackjack, video slots, video keno, video bingo, etc. Also, the attraction sequence may include notification that the gaming apparatus 20 offers the personal wide area progressive jackpot feature. The sequence may also provided information explaining the personal wide area progressive jackpot feature as well as its benefits.

During performance of the attraction sequence, if a potential player makes any input to the gaming unit 20 as determined at a block 204, the system may check at a block 206 to see if the player inserted a player tracking card, such as a smart card or credit card, for example, into the card reader 58. If it is determined at the block 206 that a player tracking card was not used, then the gaming apparatus 20 will operate in a conventional manner, by proceeding to generate a game display at a block 208. If the card reader 58 detects that a compatible player tracking card 59 was inserted into the gaming apparatus 20, then the gaming apparatus may acquire player tracking data at a block 260 that is associated with the player from a player tracking database, such as database 44, 47, or 48 from FIGS. 1A and 1B. This may be accomplished using the techniques discussed with reference to FIGS. 1A and 1B.

After accessing the player tracking database and acquiring the player's file of player tracking data, the gaming apparatus 20 may determine if the player is an active personal wide area progressive member at a block 262. This may be as simple as checking to see if the player has previously registered to participate in a personal wide area progressive jackpot. The system may also be set up so that all players using a player tracking card are automatically registered for, or are eligible to participate in a personal wide area progressive jackpot. If all players using a player tracking card are registered by default, the system may simply check to ensure that the player has not been excluded from participating in a personal wide area progressive jackpot for whatever reason. Also, if the system requires registration or some other active step to participate in a personal wide area progressive jackpot, then the gaming apparatus 20 may explain the benefits of participating in a personal wide area progressive jackpot and prompt the player to register and join. If for whatever reason the player does not choose to join/participate, then the gaming apparatus 20 will operate in a conventional manner and proceed to the block 208.

Once the gaming apparatus 20 has checked for the insertion of a player tracking card, the attraction sequence may be terminated and the routine 200 may display the current player tracking data at a block 264. The player tracking data may be displayed by having the controller 100 generate a player status video image which represents the most current player tracking data. This data may include for example, the balance for a player's current credit account and the balance for the player's current wide area progressive jackpot. This may be displayed as a section of the existing video image, or it may comprise a completely new video image.

Thereafter, a game-selection display may be generated on the display unit 70 at the block 208 to allow the player to select a game available on the gaming unit 20. The gaming unit 20 may also detect an input at the block 204 in other ways. For example, the gaming unit 20 could detect if the player presses any button on the gaming unit 20; the gaming unit 20 could determine if the player deposited one or more coins into the gaming unit 20; the gaming unit 20 could determine if player deposited paper currency into the gaming unit; etc.

The game-selection display generated at the block 208 may include, for example, a list of video games that may be played on the gaming unit 20 and/or a visual message to prompt the player to deposit value into the gaming unit 20. While the game-selection display is generated, the gaming unit 20 may wait for the player to make a game selection at a block 266.

FIG. 4B is the second half of the flowchart of the main operating routine 200. Upon selection of one of the games by the player as determined at the block 266, the controller 100 may cause one of a number of game routines to be performed to allow the selected game to be played. For example, the game routines could include a video poker routine 210, a video blackjack routine 220, a slots routine 230, a video keno routine 240, and a video bingo routine 250. At the block 266 from FIG. 4A, if no game selection is made within a given period of time, the operation may branch back to wait for a game to be selected by the player.

Referring back to FIG. 4B, after one of the routines 210, 220, 230, 240, 250 has been performed to allow the player to play one of the games, a block 270 may be utilized to determine if the player was playing for a personal wide area progressive jackpot. If not, the routine 200 will advance to a block 272 to increment the player's credit account according to the games paytable. Otherwise, the routine 200 will advance to a block 274 where it will determine if the player won a qualified personal wide area progressive win. A qualified personal wide area progressive win may comprise the top win for the game that was played. The qualifying win or wins may be designated in the games pay table or in another section of the video image. For example, if the player was playing poker via the video poker routine 210, a qualifying win may be a royal flush. Or, if the player was playing blackjack via the video blackjack routine 220, a qualifying win may be blackjack. There may also be additional wins for each of the games that may be considered qualified wins for purposes of a personal wide area progressive jackpot. The controller 100 may also be programmed to require consecutive top wins in some games to be eligible for the personal wide area progressive jackpot. This may be necessary in games such as blackjack, where the odds are quite high of a player winning with a blackjack in comparison to the odds of a player winning a poker game with a royal flush.

If at the block 274 it is determined that the player won a game that was a qualified personal wide area progressive win, then the controller 100 may lock the game, as in a tilt scenario, at a block 276. The facility management, official representatives, or other designated personnel may perform a prize verification for security purposes. At a block 278, the gaming apparatus may retrieve, if it has not already done so, the player's personal wide area progressive jackpot balance and add that total to the player's credit account. Instead of incrementing the player's credit account by the personal wide area progressive jackpot balance, the facility or other personnel may directly pay the player for the personal wide area progressive jackpot. The player's personal wide area progressive jackpot balance may then be reset at the block 278.

The player's personal wide area progressive balance may be reset to a zero balance, or it may be reset to a higher amount. The reset amount may be a fixed amount, for example $5,000, or it may be a variable amount based on the player's gaming history as recorded in the player's player tracking data. It may be beneficial to reset the account of an avid, high stakes player to a higher balance than that of a one time visitor. Resetting the personal wide area progressive jackpot balance to a higher amount will provide an incentive for the player to once again use the proprietary personal wide area progressive, which will lead to increased financial gains as a result of the increased attraction and utilization. In other words, because the players will benefit from the ability to contribute to their own personal wide area progressive jackpot, they will be enticed to play and spend more. Thus, the facilities and/or owners will benefit from the increased player traffic and game play.

At the block 272, the player's credit account may then be incremented according to the game's pay table. Going back to the block 274, if after playing one of the games, it is determined that the player did not win one of the qualified personal wide area progressive wins, then the system may increment the player's credit account by a contribution amount. This is shown at a block 280. The contribution amount may be a percentage of the player's wager for that game. For example, 1% of all wagers may go back to the player's personal wide area progressive jackpot. Thus, $0.01 would be added for a $1 wager and $0.05 would be added for a $5 wager. The contribution amount may also be a small fixed amount. For example, $0.02 may be added to the player's personal wide area progressive jackpot for all wagers the player would make. The player's credit account may then be incremented according to the game's paytable for the given outcome of the game, as shown at the block 272.

After incrementing the player's credit account according to the paytable at the block 272, a block 282 may be utilized to determine whether the player wishes to terminate play on the gaming unit 20 or to select another game. If the player wishes to stop playing the gaming unit 20, which wish may be expressed, for example, by selecting a "Cash Out" button, the controller 100 may dispense value to the player at block 284 based on the outcome of the game(s) played by the player and a personal wide area progressive jackpot that may have been won and not already paid by the facility or other representative. The operation may then return to block 202. If the player did not wish to quit as determined at the block 282, the routine may return to block 264 where the current player tracking data is displayed which may include the newly incremented or reset personal wide area progressive jackpot balance. Then, at the block 208, the game-selection display may again be generated to allow the player to select another game. After deciding not to quit play at the block 282, the routine 200 may also return to the block 208 where the game display will be generated. Thus skipping the display of the current player tracking data.

It should be noted that although five gaming routines are shown in FIG. 4B, a different number of routines could be included to allow play of a different number of games. The gaming unit 20 may also be programmed to allow play of different games.

It should also be noted that both of the embodiments shown in FIGS. 1A and 1B provide the ability for a user to contribute to and win their personal wide area progressive jackpot at any participating property, such as the gaming units 20 located at the first facility and the gaming units 30 located at the second facility. In other words, no matter what participating facility the player is at, he or she may contribute to their personal wide area progressive jackpot based on their own play, and their personal wide area progressive jackpot may follow them to any participating property. The interconnections shown in FIGS. 1A and 1B also provide advantages over conventional bonus systems because once the player's player tracking card is inserted in the gaming unit 20 or 30, they only affect their own jackpot balance, and their contributions are not limited to a single property.

Video Poker

Figure 5:
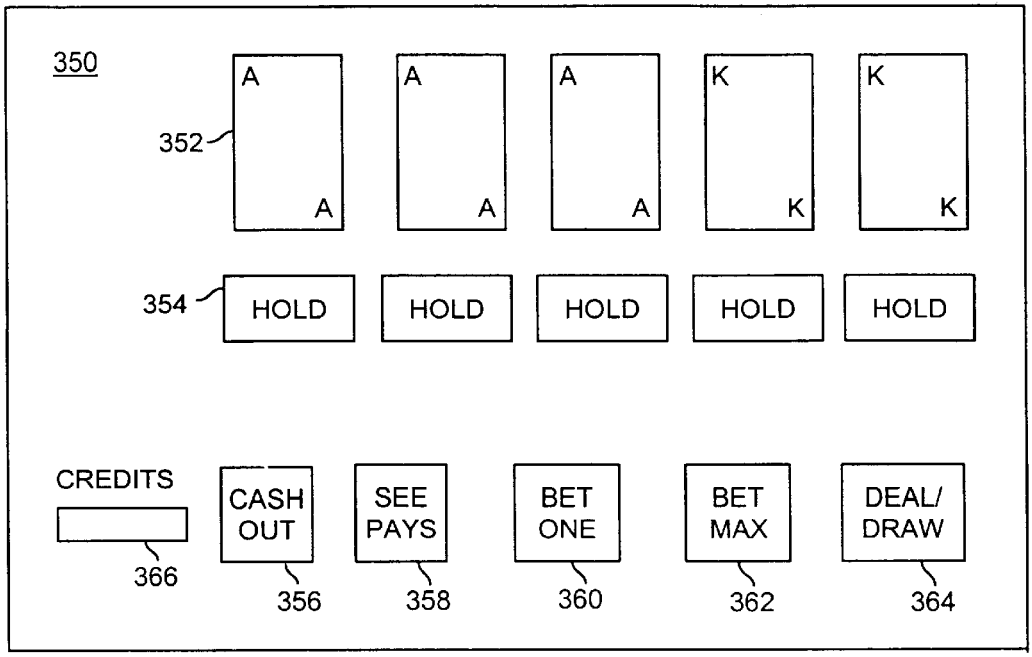
FIG. 5 is an illustration of an embodiment of a visual display that may be displayed during performance of the video poker routine of FIG. 7.
Figure 7:
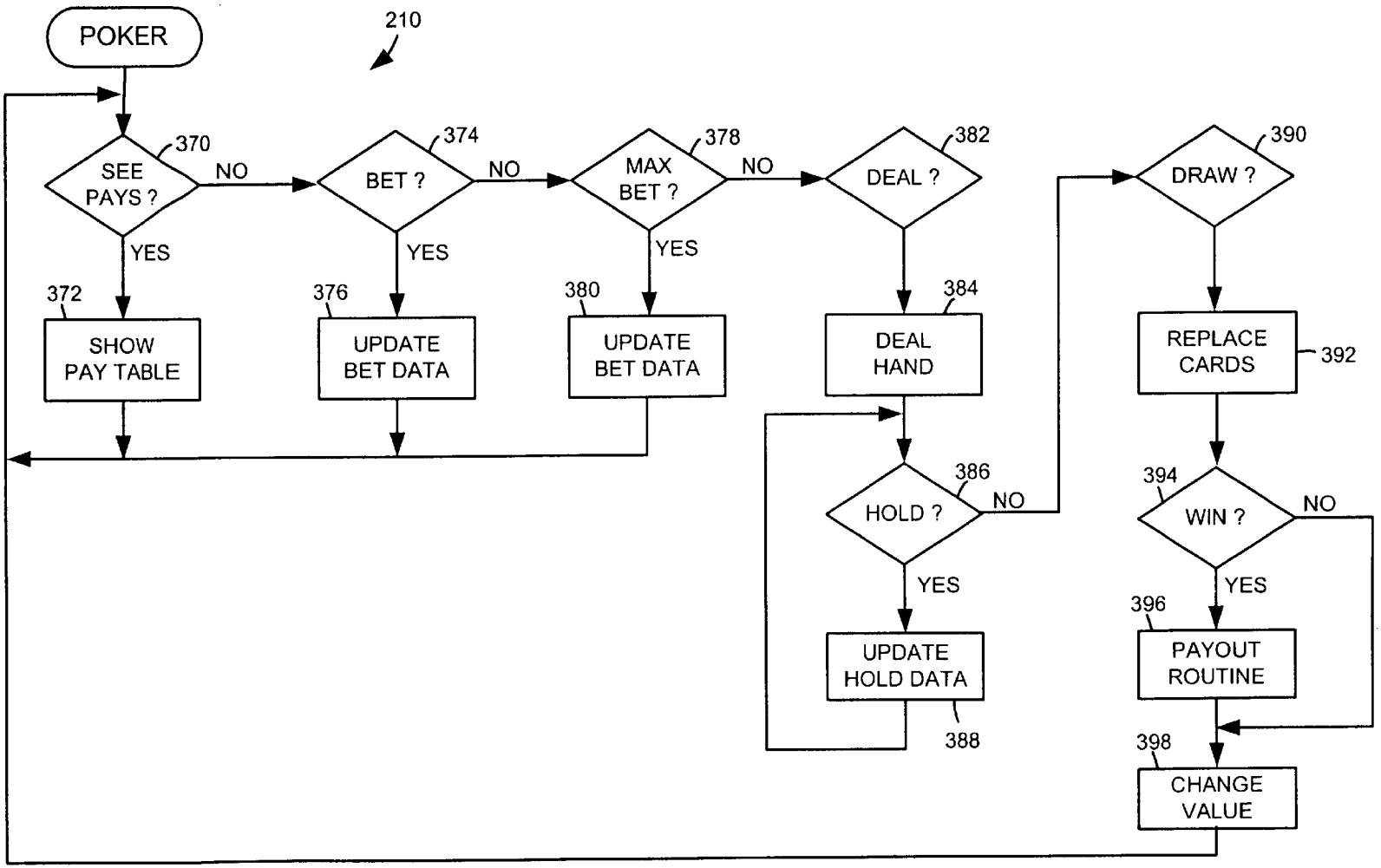
FIG. 7 is a flowchart of an embodiment of a video poker routine that may be performed by one or more of the gaming units.

FIG. 5 is an exemplary display 350 that may be shown on the display unit 70 during performance of the video poker routine 210 shown schematically in FIG. 4B. Referring to FIG. 5, the display 350 may include video images 352 of a plurality of playing cards representing the player's hand, such as five cards. To allow the player to control the play of the video poker game, a plurality of player-selectable buttons may be displayed. The buttons may include a "Hold" button 354 disposed directly below each of the playing card images 352, a "Cash Out" button 356, a "See Pays" button 358, a "Bet One Credit" button 360, a "Bet Max Credits" button 362, and a "Deal/Draw" button 364. The display 350 may also include an area 366 in which the number of remaining credits or value is displayed. If the display unit 70 is provided with a touch-sensitive screen, the buttons 354, 356, 358, 360, 362, 364 may form part of the video display 350. Alternatively, one or more of those buttons may be provided as part of a control panel that is provided separately from the display unit 70. FIG. 7 is a flowchart of the video poker routine 210 shown schematically in FIG. 4B. Referring to FIG. 7, at block 370, the routine may determine whether the player has requested payout information, such as by activating the "See Pays" button 358, in which case at block 372 the routine may cause one or more pay tables to be displayed on the display unit 70. At block 374, the routine may determine whether the player has made a bet, such as by pressing the "Bet One Credit" button 360, in which case at block 376 bet data corresponding to the bet made by the player may be stored in the memory of the controller 100. At block 378, the routine may determine whether the player has pressed the "Bet Max Credits" button 362, in which case at block 380 bet data corresponding to the maximum allowable bet may be stored in the memory of the controller 100.

At block 382, the routine may determine if the player desires a new hand to be dealt, which may be determined by detecting if the "Deal/Draw" button 364 was activated after a wager was made. In that case, at block 384 a video poker hand may be "dealt" by causing the display unit 70 to generate the playing card images 352. After the hand is dealt, at block 386 the routine may determine if any of the "Hold" buttons 354 have been activated by the player, in which case data regarding which of the playing card images 352 are to be "held" may be stored in the controller 100 at block 388. If the "Deal/Draw" button 364 is activated again as determined at block 390, each of the playing card images 352 that was not "held" may be caused to disappear from the video display 350 and to be replaced by a new, randomly selected, playing card image 352 at block 392.

At block 394, the routine may determine whether the poker hand represented by the playing card images 352 currently displayed is a winner. That determination may be made by comparing data representing the currently displayed poker hand with data representing all possible winning hands, which may be stored in the memory of the controller 100. If there is a winning hand, a payout value corresponding to the winning hand may be determined at block 396. At block 398, the player's cumulative value or number of credits may be updated by subtracting the bet made by the player and adding, if the hand was a winner, the payout value determined at block 396. The cumulative value or number of credits may also be displayed in the display area 366 (FIG. 5).

Although the video poker routine 210 is described above in connection with a single poker hand of five cards, the routine 210 may be modified to allow other versions of poker to be played. For example, seven card poker may be played, or stud poker may be played. Alternatively, multiple poker hands may be simultaneously played. In that case, the game may begin by dealing a single poker hand, and the player may be allowed to hold certain cards. After deciding which cards to hold, the held cards may be duplicated in a plurality of different poker hands, with the remaining cards for each of those poker hands being randomly determined.

Video Blackjack

Figure 6:
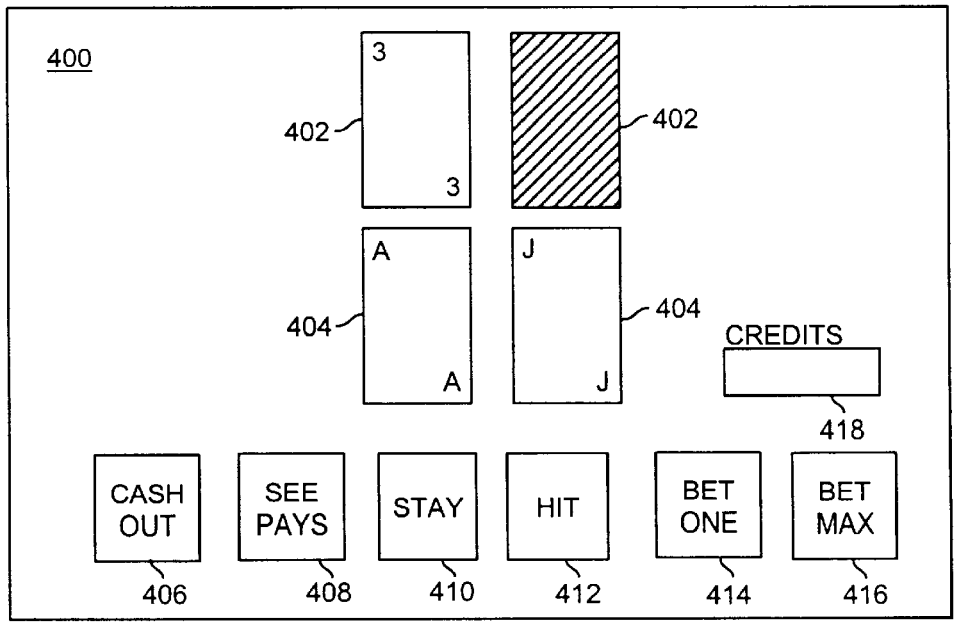
FIG. 6 is an illustration of an embodiment of a visual display that may be displayed during performance of the video blackjack routine of FIG. 8.

FIG. 6 is an exemplary display 400 that may be shown on the display unit 70 during performance of the video blackjack routine 220 shown schematically in FIG. 4B. Referring to FIG. 6, the display 400 may include video images 402 of a pair of playing cards representing a dealer's hand, with one of the cards shown face up and the other card being shown face down, and video images 404 of a pair of playing cards representing a player's hand, with both the cards shown face up. The "dealer" may be the gaming unit 20.

To allow the player to control the play of the video blackjack game, a plurality of player-selectable buttons may be displayed. The buttons may include a "Cash Out" button 406, a "See Pays" button 408, a "Stay" button 410, a "Hit" button 412, a "Bet One Credit" button 414, and a "Bet Max Credits" button 416. The display 400 may also include an area 418 in which the number of remaining credits or value is displayed. If the display unit 70 is provided with a touch-sensitive screen, the buttons 406, 408, 410, 412, 414, 416 may form part of the video display 400. Alternatively, one or more of those buttons may be provided as part of a control panel that is provided separately from the display unit 70.

Figure 8:
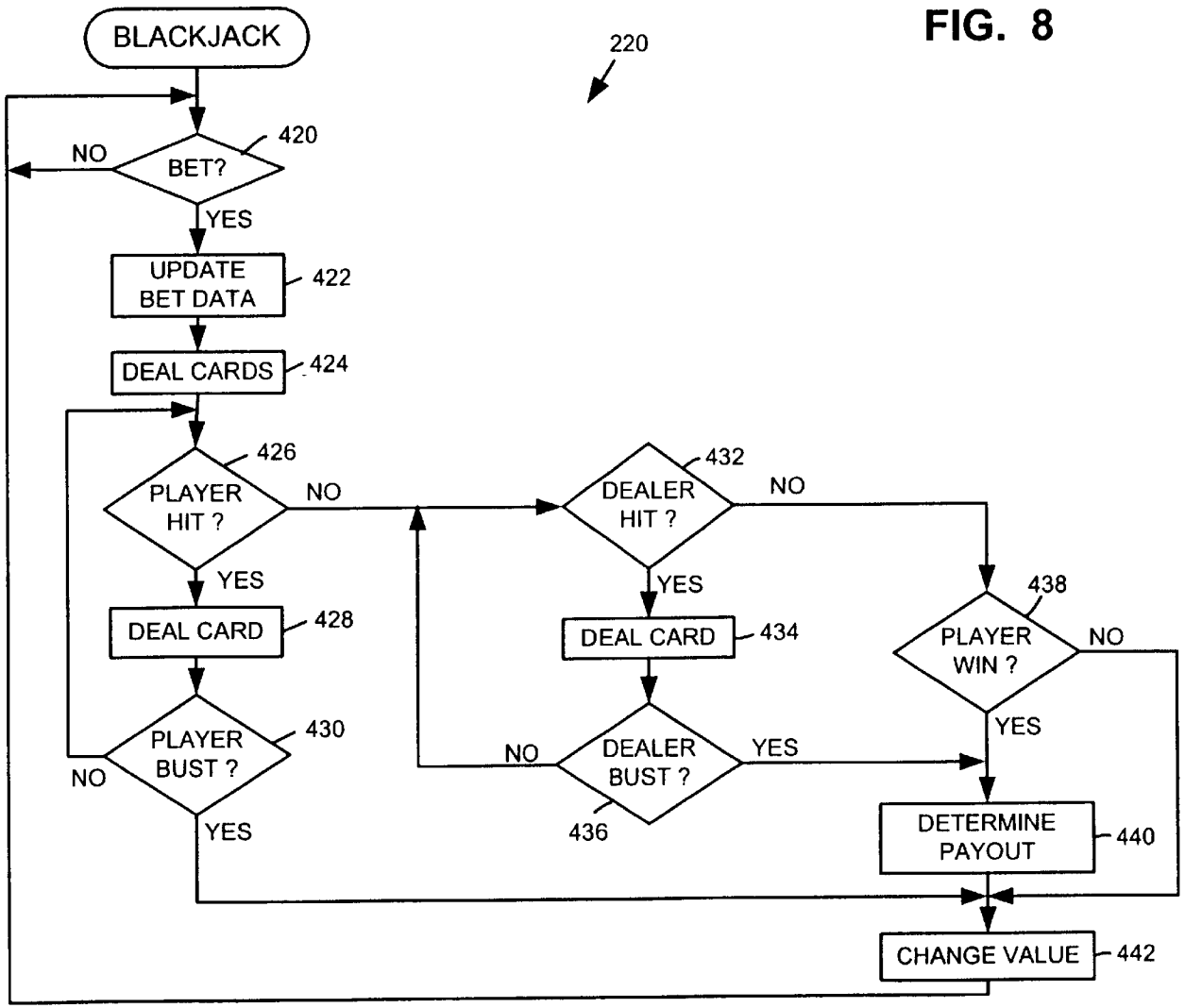
FIG. 8 is a flowchart of an embodiment of a video blackjack routine that may be performed by one or more of the gaming units.

FIG. 8 is a flowchart of the video blackjack routine 220 shown schematically in FIG. 4B. Referring to FIG. 8, the video blackjack routine 220 may begin at block 420 where it may determine whether a bet has been made by the player. That may be determined, for example, by detecting the activation of either the "Bet One Credit" button 414 or the "Bet Max Credits" button 416. At block 422, bet data corresponding to the bet made at block 420 may be stored in the memory of the controller 100. At block 424, a dealer's hand and a player's hand may be "dealt" by making the playing card images 402, 404 appear on the display unit 70.

At block 426, the player may be allowed to be "hit," in which case at block 428 another card will be dealt to the player's hand by making another playing card image 404 appear in the display 400. If the player is hit, block 430 may determine if the player has "bust," or exceeded 21. If the player has not bust, blocks 426 and 428 may be performed again to allow the player to be hit again.

If the player decides not to hit, at block 432 the routine may determine whether the dealer should be hit. Whether the dealer hits may be determined in accordance with predetermined rules, such as the dealer always hit if the dealer's hand totals 15 or less. If the dealer hits, at block 434 the dealer's hand may be dealt another card by making another playing card image 402 appear in the display 400. At block 436 the routine may determine whether the dealer has bust. If the dealer has not bust, blocks 432, 434 may be performed again to allow the dealer to be hit again.

If the dealer does not hit, at block 436 the outcome of the blackjack game and a corresponding payout may be determined based on, for example, whether the player or the dealer has the higher hand that does not exceed 21. If the player has a winning hand, a payout value corresponding to the winning hand may be determined at block 440. At block 442, the player's cumulative value or number of credits may be updated by subtracting the bet made by the player and adding, if the player won, the payout value determined at block 440. The cumulative value or number of credits, as well as the player's personal wide area progressive jackpot balance may also be displayed in the display area 418 (FIG. 6).

Slots

FIG. 9 is an exemplary display 450 that may be shown on the display unit 70 during performance of the slots routine 230 shown schematically in FIG. 4B. Referring to FIG. 9, the display 450 may include video images 452 of a plurality of slot machine reels, each of the reels having a plurality of reel symbols 454 associated therewith. Although the display 450 shows five reel images 452, each of which may have three reel symbols 454 that are visible at a time, other reel configurations could be utilized.

To allow the player to control the play of the slots game, a plurality of player-selectable buttons may be displayed. The buttons may include a "Cash Out" button 456, a "See Pays" button 458, a plurality of payline-selection buttons 460 each of which allows the player to select a different number of paylines prior to "spinning" the reels, a plurality of bet-selection buttons 462 each of which allows a player to specify a wager amount for each payline selected, a "Spin" button 464, and a "Max Bet" button 466 to allow a player to make the maximum wager allowable.

Figure 11:
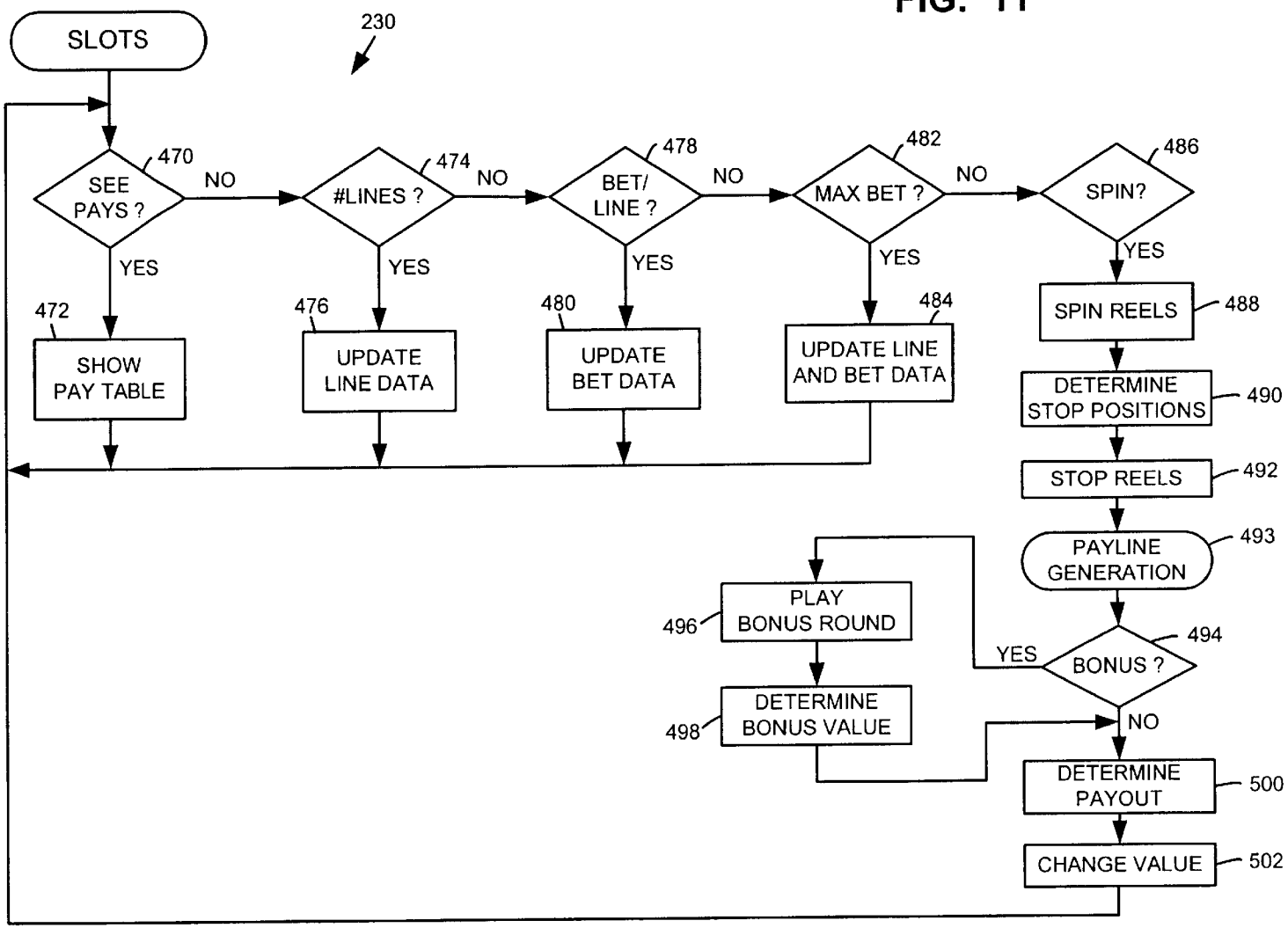
FIG. 11 is a flowchart of an embodiment of a slots routine that may be performed by one or more of the gaming units.
Figure 13:
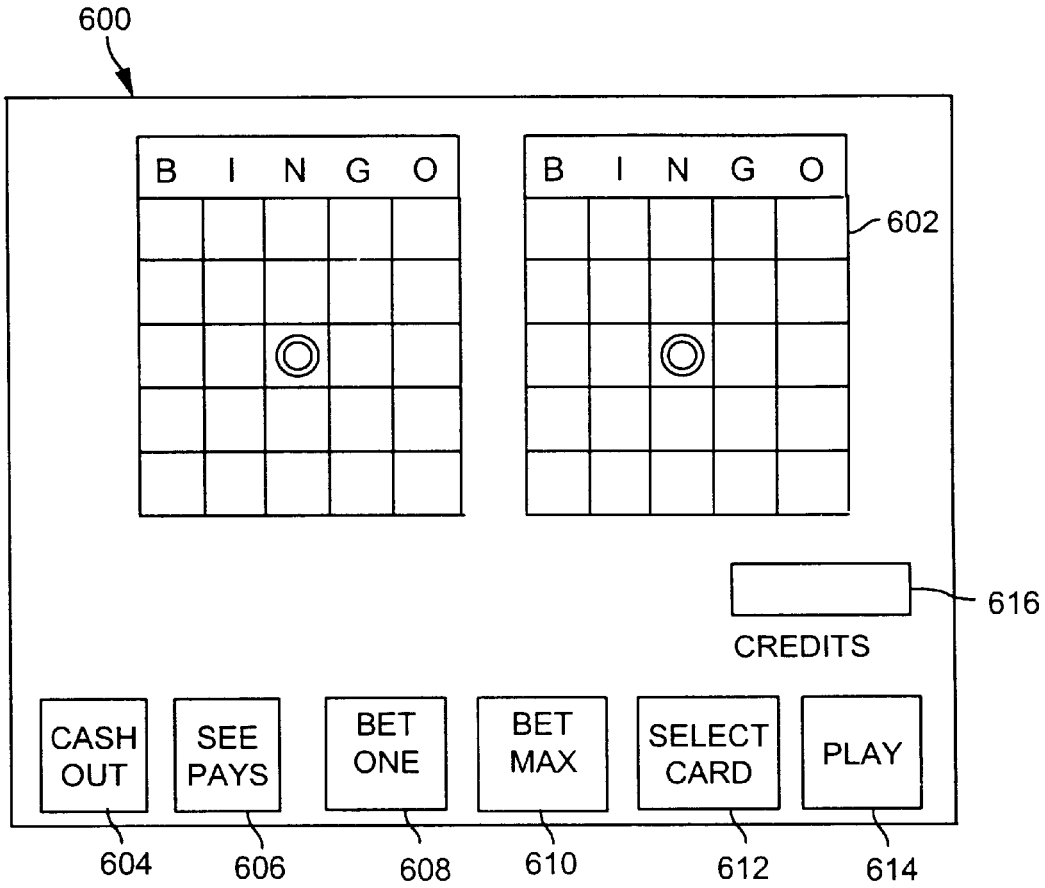
FIG. 13 is an illustration of an embodiment of a visual display that may be displayed during performance of the video bingo routine of FIG. 14.

FIG. 11 is a flowchart of the slots routine 230 shown schematically in FIG. 13. Referring to FIG. 11, at block 470, the routine may determine whether the player has requested payout information, such as by activating the "See Pays" button 458, in which case at block 472 the routine may cause one or more pay tables to be displayed on the display unit 70. At block 474, the routine may determine whether the player has pressed one of the payline-selection buttons 460, in which case at block 476 data corresponding to the number of paylines selected by the player may be stored in the memory of the controller 100. At block 478, the routine may determine whether the player has pressed one of the bet-selection buttons 462, in which case at block 480 data corresponding to the amount bet per payline may be stored in the memory of the controller 100. At block 482, the routine may determine whether the player has pressed the "Max Bet" button 466, in which case at block 484 bet data (which may include both payline data and bet-per-payline data) corresponding to the maximum allowable bet may be stored in the memory of the controller 100.

If the "Spin" button 464 has been activated by the player as determined at block 486, at block 488 the routine may cause the slot machine reel images 452 to begin "spinning" so as to simulate the appearance of a plurality of spinning mechanical slot machine reels. At block 490, the routine may determine the positions at which the slot machine reel images will stop, or the particular symbol images 454 that will be displayed when the reel images 452 stop spinning. At block 492, the routine may stop the reel images 452 from spinning by displaying stationary reel images 452 and images of three symbols 454 for each stopped reel image 452. The virtual reels may be stopped from left to right, from the perspective of the player, or in any other manner or sequence.

The routine may provide for the possibility of a bonus game or round if certain conditions are met, such as the display in the stopped reel images 452 of a particular symbol 454. If there is such a bonus condition as determined at block 494, the routine may proceed to block 496 where a bonus round may be played. The bonus round may be a different game than slots, and many other types of bonus games could be provided, such as a personal wide area progressive jackpot. If the player wins the bonus round, or receives additional credits or points in the bonus round, a bonus value may be determined at block 498. A payout value corresponding to outcome of the slots game and/or the bonus round may be determined at block 500. At block 502, the player's cumulative value or number of credits may be updated by subtracting the bet made by the player and adding, if the slot game and/or bonus round was a winner, the payout value determined at block 500.

Although the above routine has been described as a virtual slot machine routine in which slot machine reels are represented as images on the display unit 70, actual slot machine reels that are capable of being spun may be utilized instead.

Video Keno

FIG. 10 is an exemplary display 520 that may be shown on the display unit 70 during performance of the video keno routine 240 shown schematically in FIG. 4B. Referring to FIG. 10, the display 520 may include a video image 522 of a plurality of numbers that were selected by the player prior to the start of a keno game and a video image 524 of a plurality of numbers randomly selected during the keno game. The randomly selected numbers may be displayed in a grid pattern.

To allow the player to control the play of the keno game, a plurality of player-selectable buttons may be displayed. The buttons may include a "Cash Out" button 526, a "See Pays" button 528, a "Bet One Credit" button 530, a "Bet Max Credits" button 532, a "Select Ticket" button 534, a "Select Number" button 536, and a "Play" button 538. The display 520 may also include an area 540 in which the number of remaining credits or value is displayed. If the display unit 70 is provided with a touch-sensitive sensitive screen, the buttons may form part of the video display 520. Alternatively, one or more of those buttons may be provided as part of a control panel that is provided separately from the display unit 70.

Figure 12:
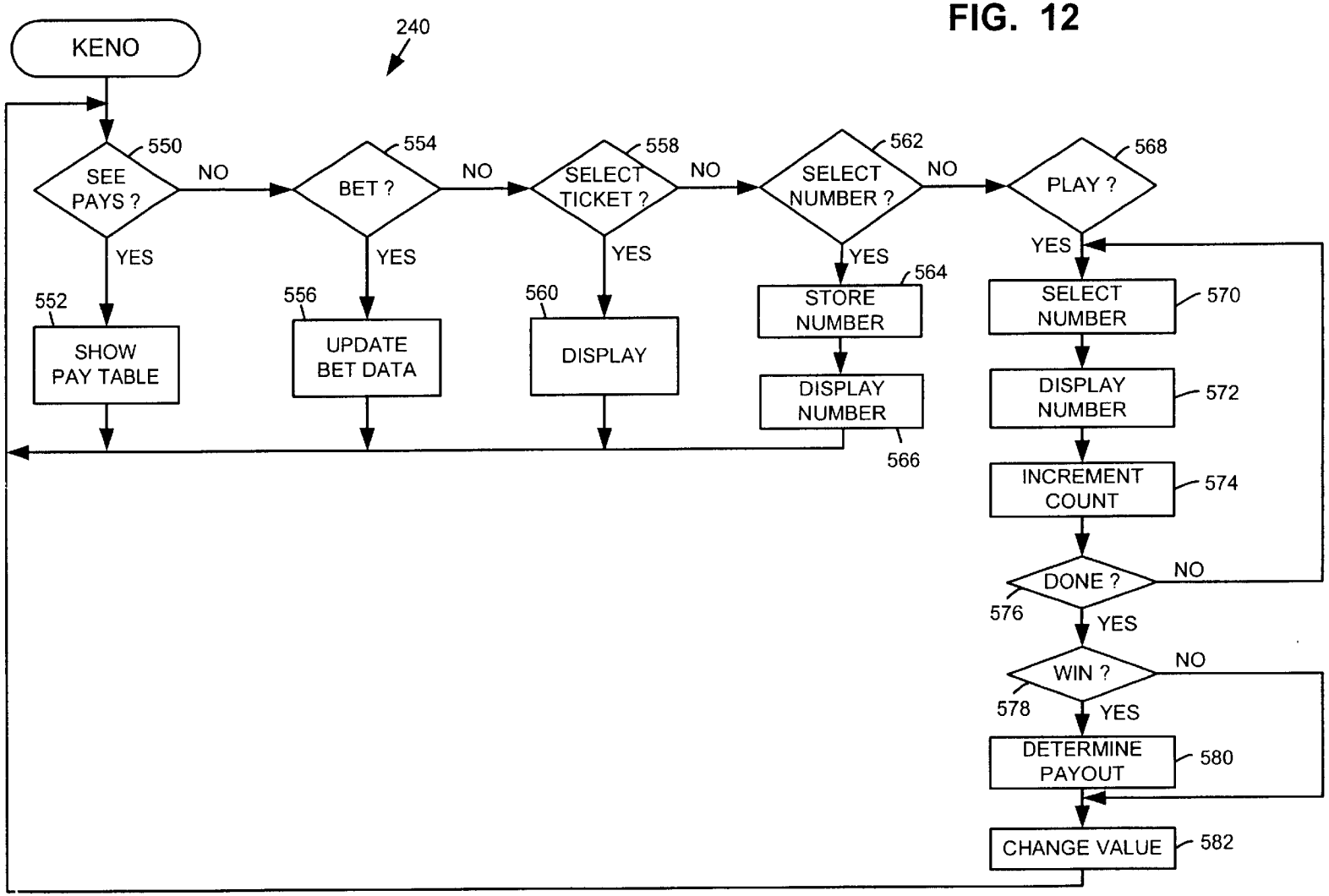
FIG. 12 is a flowchart of an embodiment of a video keno routine that may be performed by one or more of the gaming units.

FIG. 12 is a flowchart of the video keno routine 240 shown schematically in FIG. 4B. The keno routine 240 may be utilized in connection with a single gaming unit 20 where a single player is playing a keno game, or the keno routine 240 may be utilized in connection with multiple gaming units 20 where multiple players are playing a single keno game. In the latter case, one or more of the acts described below may be performed either by the controller 100 in each gaming unit or by one of the network computer 22, 32 to which multiple gaming units 20 are operatively connected.

Referring to FIG. 12, at block 550, the routine may determine whether the player has requested payout information, such as by activating the "See Pays" button 528, in which case at block 552 the routine may cause one or more pay tables to be displayed on the display unit 70. At block 554, the routine may determine whether the player has made a bet, such as by having pressed the "Bet One Credit" button 530 or the "Bet Max Credits" button 532, in which case at block 556 bet data corresponding to the bet made by the player may be stored in the memory of the controller 100. After the player has made a wager, at block 558 the player may select a keno ticket, and at block 560 the ticket may be displayed on the display 520. At block 562, the player may select one or more game numbers, which may be within a range set by the casino. After being selected, the player's game numbers may be stored in the memory of the controller 100 at block 564 and may be included in the image 522 on the display 520 at block 566. After a certain amount of time, the keno game may be closed to additional players (where a number of players are playing a single keno game using multiple gambling units 20).

If play of the keno game is to begin as determined at block 568, at block 570 a game number within a range set by the casino may be randomly selected either by the controller 100 or a central computer operatively connected to the controller, such as one of the network computers 22, 32. At block 572, the randomly selected game number may be displayed on the display unit 70 and the display units 70 of other gaming units 20 (if any) which are involved in the same keno game. At block 574, the controller 100 (or the central computer noted above) may increment a count which keeps track of how many game numbers have been selected at block 570.

At block 576, the controller 100 (or one of the network computers 22, 32) may determine whether a maximum number of game numbers within the range have been randomly selected. If not, another game number may be randomly selected at block 570. If the maximum number of game numbers has been selected, at block 578 the controller 100 (or a central computer) may determine whether there are a sufficient number of matches between the game numbers selected by the player and the game numbers selected at block 570 to cause the player to win. The number of matches may depend on how many numbers the player selected and the particular keno rules being used.

If there are a sufficient number of matches, a payout may be determined at block 580 to compensate the player for winning the game. The payout may depend on the number of matches between the game numbers selected by the player and the game numbers randomly selected at block 570. At block 582, the player's cumulative value or number of credits may be updated by subtracting the bet made by the player and adding, if the keno game was won, the payout value determined at block 580. The cumulative value or number of credits and the player's personal wide area progressive jackpot balance may also be displayed in the display area 540 (FIG. 10).

Video Bingo

FIG. 13 is an exemplary display 600 that may be shown on the display unit 70 during performance of the video bingo routine 250 shown schematically in FIG. 4B. Referring to FIG. 13, the display 600 may include one or more video images 602 of a bingo card and images of the bingo numbers selected during the game. The bingo card images 602 may have a grid pattern.

To allow the player to control the play of the bingo game, a plurality of player-selectable buttons may be displayed. The buttons may include a "Cash Out" button 604, a "See Pays" button 606, a "Bet One Credit" button 608, a "Bet Max Credits" button 610, a "Select Card" button 612, and a "Play" button 614. The display 600 may also include an area 616 in which the number of remaining credits or value is displayed. If the display unit 70 is provided with a touch-sensitive screen, the buttons may form part of the video display 600. Alternatively, one or more of those buttons may be provided as part of a control panel that is provided separately from the display unit 70.

Figure 14:
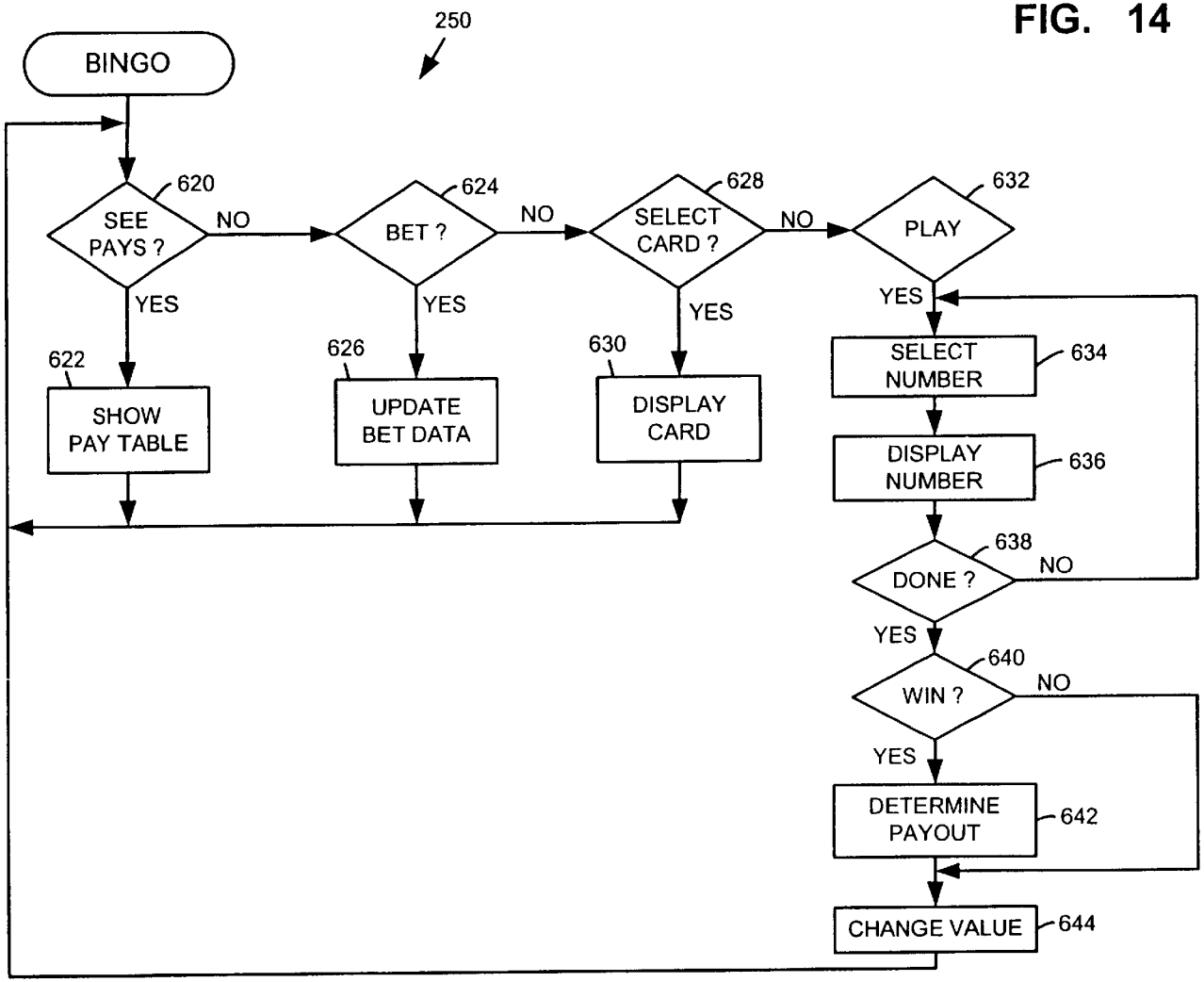
FIG. 14 is a flowchart of an embodiment of a video bingo routine that may be performed by one or more of the gaming units.

FIG. 14 is a flowchart of the video bingo routine 250 shown schematically in FIG. 4B. The bingo routine 250 may be utilized in connection with a single gaming unit 20 where a single player is playing a bingo game, or the bingo routine 250 may be utilized in connection with multiple gaming units 20 where multiple players are playing a single bingo game. In the latter case, one or more of the acts described below may be performed either by the controller 100 in each gaming unit 20 or by one of the network computers 22, 32 to which multiple gaming units 20 are operatively connected.

Referring to FIG. 14, at block 620, the routine may determine whether the player has requested payout information, such as by activating the "See Pays" button 606, in which case at block 622 the routine may cause one or more pay tables to be displayed on the display unit 70. At block 624, the routine may determine whether the player has made a bet, such as by having pressed the "Bet One Credit" button 608 or the "Bet Max Credits" button 610, in which case at block 626 bet data corresponding to the bet made by the player may be stored in the memory of the controller 100.

After the player has made a wager, at block 628 the player may select a bingo card, which may be generated randomly. The player may select more than one bingo card, and there may be a maximum number of bingo cards that a player may select. After play is to commence as determined at block 632, at block 634 a bingo number may be randomly generated by the controller 100 or a central computer such as one of the network computers 22, 32. At block 636, the bingo number may be displayed on the display unit 70 and the display units 70 of any other gaming units 20 involved in the bingo game.

At block 638, the controller 100 (or a central computer) may determine whether any player has won the bingo game. If no player has won, another bingo number may be randomly selected at block 634. If any player has bingo as determined at block 638, the routine may determine at block 640 whether the player playing that gaming unit 20 was the winner. If so, at block 642 a payout for the player may be determined. The payout may depend on the number of random numbers that were drawn before there was a winner, the total number of winners (if there was more than one player), and the amount of money that was wagered on the game. At block 644, the player's cumulative value or number of credits may be updated by subtracting the bet made by the player and adding, if the bingo game was won, the payout value determined at block 642. The cumulative value or number of credits and the player's personal wide area progressive jackpot balance may also be displayed in the display area 616 (FIG. 13).

Numerous modifications and alternative embodiments of the invention will be apparent to those skilled in the art in view of the foregoing description. This description is to be construed as illustrative only, and is for the purpose of teaching those skilled in the art the best mode of carrying out the invention. The details of the structure and method may be varied substantially without departing from the spirit of the invention, and the exclusive use of all modifications which come within the scope of the appended claims is reserved.

What is claimed is:

1. A gaming apparatus, comprising:

a display unit that is capable of generating video images;

a value input device;

a player tracking card reader;

a controller operatively coupled to said display unit, said value input device, and said player tracking card reader, said controller comprising a processor and a memory operatively coupled to said processor, said controller being programmed to allow a player to make a wager, said controller being programmed to cause a video image to be generated on said display unit, said video image representing a game selected from said group of games consisting of video poker, video blackjack, video slots, video keno and video bingo, said video image comprising an image of at least five playing cards if said game comprises video poker, said video image comprising an image of a plurality of simulated slot machine reels if said game comprises video slots, said video image comprising an image of a plurality of playing cards if said game comprises video blackjack, said video image comprising an image of a plurality of keno numbers if said game comprises video keno, said video image comprising an image of a bingo grid if said game comprises video bingo, said controller being programmed to read a player tracking card, acquire player tracking data from a player tracking database, and determine if said player is a personal wide area progressive member;

said controller being programmed to evaluate an outcome of said game represented by said video image;

said controller being programmed to determine if said outcome of said game was a qualified personal wide area progressive jackpot win;

said controller being programmed to increment a credit account for said player by a personal wide area progressive jackpot total if said outcome of said game was a qualified personal wide area progressive jackpot win, wherein said personal wide area progressive jackpot total represents a cash value;

said controller being programmed to reset said personal wide area progressive jackpot total to a cash amount correlating to said player's gaming history if said outcome of said game was a qualified personal wide area progressive jackpot win;

said controller being programmed to increment said personal wide area progressive jackpot total for said player by a cash contribution amount if said outcome of said game was not a qualified personal wide area progressive jackpot win; and said controller being programmed to lock said gaming apparatus and perform a jackpot verification if said outcome of said game was a qualified personal wide area progressive jackpot win.

2. A gaming apparatus as defined in claim 1, wherein said controller is programmed to prompt said user to become a personal wide area progressive member if it is determined that said player was not currently a personal wide area progressive member.

3. A gaming apparatus as defined in claim 1, wherein said player tracking database comprises a remote, central database.

4. A gaming system comprising a plurality of gaming apparatuses as defined in claim 3, said gaming apparatuses being interconnected to form a network of gaming apparatuses and wherein said gaming apparatuses are located in a plurality of facilities with each of said gaming apparatuses having access to said player tracking database.

5. A gaming apparatus as defined in claim 1, wherein said player tracking database comprises a local, satellite database that is periodically updated by a remote, central database.

6. A gaming apparatus as defined in claim 1, wherein said cash contribution amount comprises a percentage of said player's wager.

7. A gaming apparatus as defined in claim 1, wherein said cash contribution amount comprises a predetermined cash amount less than one dollar.

8. A gaming system comprising a plurality of gaming apparatuses as defined in claim 1, said gaming apparatuses being interconnected to form a network of gaming apparatuses.

9. A gaming system as defined in claim 1, wherein said gaming apparatuses are interconnected via an Internet.

10. A gaming apparatus as defined in claim 1, wherein said controller is further programmed to generate a player status video image representing current player tracking data.

11. A gaming apparatus, comprising:

a display unit that is capable of generating video images;

a value input device;

a player tracking card reader;

a controller operatively coupled to said display unit, said value input device, and said player tracking card reader, said controller comprising a processor and a memory operatively coupled to said processor, said controller being programmed to allow a person to make a wager, said controller being programmed to allow a person to make a payline selection, said controller being programmed to cause a video image to be generated on said display unit, said video image comprising a plurality of simulated slot machine reels of a slots game, each of said slot machine reels having a plurality of slot machine symbols, said controller being programmed to read a player tracking card, acquire player tracking data from a player tracking database, and determine if a player is a personal progressive member;

said controller being programmed to determine a value payout associated with an outcome of said slots game, said controller being programmed to determine said outcome of said slots game based on a configuration of said slot machine symbols;

said controller being programmed to determine if said outcome of said slots game was a qualified personal progressive jackpot win;

said controller being programmed to increment a credit account for said player by a personal progressive jackpot total if said outcome of said slots game was a qualified personal progressive jackpot win, wherein said personal progressive jackpot total represents a cash value;

said controller being programmed to reset said personal progressive jackpot total to a cash amount correlating to said player's gaming history if said outcome of said game was a qualified personal progressive jackpot win; and said controller being programmed to add a percentage of a cash amount of said wager to a current cash value of said personal progressive jackpot if said outcome of said game was not a qualified personal progressive jackpot win.

12. A gaming apparatus as defined in claim 11, wherein said controller is programmed to prompt said user to become a personal progressive member if it is determined that said player was not currently a personal progressive member.

13. A gaming system comprising a plurality of gaming apparatuses as defined in claim 11, said gaming apparatuses being interconnected to form a network of gaming apparatuses.

14. A gaming apparatus as defined in claim 11, wherein said player tracking database comprises a remote, central database.

15. A gaming apparatus as defined in claim 11, wherein said personal progressive jackpot is a personal wide area progressive jackpot.

16. A gaming method comprising:

causing a video image to be generated, said video image representing a game selected from the group of games consisting of video poker, video blackjack, video slots, video keno and video bingo, said video image comprising an image of at least five playing cards if said game comprises video poker, said video image comprising an image of a plurality of simulated slot machine reels if said game comprises video slots, said video image comprising an image of a plurality of playing cards if said game comprises video blackjack, said video image comprising an image of a plurality of keno numbers if said game comprises video keno, and said video image comprising an image of a bingo grid if said game comprises video bingo;

reading a player tracking card;

acquiring player tracking data from a player tracking database;

determining if a player is a personal progressive member that is eligible to win a personal progressive jackpot;

evaluating an outcome of said game represented by said video image;

determining if said outcome of said game was a qualified personal progressive jackpot win;

incrementing a credit account for said player by a personal progressive jackpot total if said outcome of said game was a qualified personal progressive jackpot win, wherein said personal progressive jackpot total represents a cash value;

resetting said personal progressive jackpot total to cash amount correlating to said player's gaming history if said outcome of said game was a qualified personal progressive jackpot win; and incrementing said personal progressive jackpot total by a cash contribution amount if said outcome of said game was not a qualified personal progressive jackpot win.

17. A gaming method as defined in claim 16, additionally comprising prompting said user to become a personal progressive member if it is determined that said player was not currently a personal progressive member.

18. A gaming method as defined in claim 16, additionally comprising storing said player tracking data at a remote, central database.

19. A gaming method as defined in claim 16, wherein said player tracking database comprises a local, satellite database that is periodically updated by a remote, central database.

20. A gaming method as defined in claim 16, wherein said cash contribution amount comprises a percentage of a player's wager.

21. A gaming method as defined in claim 16, wherein said cash contribution amount comprises a predetermined amount less than one dollar.

22. A gaming method as defined in claim 16, additionally comprising providing access to said player tracking database from a plurality of gaming facilities.

23. A gaming method as defined in claim 16, additionally comprising locking said gaming apparatus and performing a jackpot verification if said outcome of said game was a qualified personal progressive jackpot win.

24. A gaming method as defined in claim 16, additionally comprising causing a player status video image to be generated, said player status video image representing current player tracking data.

25. A gaming method as defined in claim 16, additionally comprising:

determining if a player is a personal wide area progressive member that is eligible to win a personal wide area progressive jackpot;

determining if said outcome of said game was a qualified personal wide area progressive jackpot win;

incrementing a credit account for said player by a personal wide area progressive jackpot total if said outcome of said game was a qualified personal wide area progressive jackpot win, wherein said personal wide area progressive jackpot total represents a cash value;

resetting said personal wide area progressive jackpot total if said outcome of said game was a qualified personal wide area progressive jackpot win; and incrementing said personal wide area progressive jackpot total by a cash contribution amount if said outcome of said game was not a qualified personal wide area progressive jackpot win.

26. A slot machine, comprising:

a housing;

a transparent display portion associated with said housing;

a value input device;

a player tracking card reader;

a plurality of mechanically rotatable reels, said mechanically rotatable reels having a plurality of slot machine symbols formed thereon;

said mechanically rotatable reels being disposed in said housing so that said slot machine symbols are visible to a player through said transparent display portion;

a controller operatively coupled to said mechanically rotatable reels, said value input device, and said player tracking card reader, said controller comprising a processor and a memory operatively coupled to said processor;

said controller being programmed to read a player tracking card, acquire player tracking data from a player tracking database, and determine if a player is a personal wide area progressive member;

said controller being programmed to determine a value payout associated with an outcome of a slots game, said controller being programmed to determine said outcome of said slots game based on a configuration of said slot machine symbols;

said controller being programmed to determine if said outcome of said slots game was a qualified personal wide area progressive jackpot win;

said controller being programmed to increment a credit account for player by a personal wide area progressive jackpot total if said outcome of said slots game was a qualified personal wide area progressive jackpot win, wherein said personal wide area progressive jackpot total represents a first cash amount;

said controller being programmed to reset said personal wide area progressive jackpot total to a second cash amount correlating to said player's gaming history if said outcome of said slots game was a qualified personal wide area progressive jackpot win; and said controller being programmed to determine increment said personal wide area progressive jackpot total for said player by a cash contribution amount if said outcome of said slots game was not a qualified personal wide area progressive jackpot.

27. A slot machine as defined in claim 26, wherein said controller is programmed to prompt said user to become a personal wide area progressive member if it is determined that said player was not currently a personal wide area progressive member.

28. A slot machine as defined in claim 26, wherein said cash contribution amount comprises a percentage of said player's wager.

29. A slot machine as defined in claim 27, wherein said cash contribution amount comprises a predetermined cash amount less than one dollar.

* * * * *